US008397864B2

(12) United States Patent
Tinianov et al.

(10) Patent No.: US 8,397,864 B2
(45) Date of Patent: Mar. 19, 2013

(54) ACOUSTICAL SOUND PROOFING MATERIAL WITH IMPROVED FIRE RESISTANCE AND METHODS FOR MANUFACTURING SAME

(75) Inventors: Brandon D. Tinianov, Santa Clara, CA (US); Kevin J. Surace, Sunnyvale, CA (US)

(73) Assignee: Serious Energy, Inc., Sunnyvale, CA (US)

( * ) Notice: Subject to any disclaimer, the term of this patent is extended or adjusted under 35 U.S.C. 154(b) by 740 days.

(21) Appl. No.: 11/739,520

(22) Filed: Apr. 24, 2007

(65) Prior Publication Data

US 2008/0264721 A1 Oct. 30, 2008

(51) Int. Cl.
*E04B 1/82* (2006.01)

(52) U.S. Cl. ..... 181/290; 181/294

(58) Field of Classification Search ..... 181/286, 181/290, 294; 52/144, 145
See application file for complete search history.

(56) References Cited

U.S. PATENT DOCUMENTS

| | | | |
|---|---|---|---|
| 2,811,906 | A | 11/1957 | Chappell |
| 3,092,250 | A | 6/1963 | Knutson et al. |
| 3,106,503 | A | 10/1963 | Randall et al. |
| 3,160,549 | A | 12/1964 | Caldwell et al. |
| 3,215,225 | A | 11/1965 | Kirschner |
| 3,336,710 | A | 8/1967 | Raynes |
| 3,399,104 | A | 8/1968 | Ball, III et al. |
| 3,424,270 | A | 1/1969 | Hartman et al. |
| 3,462,899 | A | 8/1969 | Sherman |
| 3,468,750 | A | 9/1969 | Pfeifer et al. |
| 3,513,009 | A | 5/1970 | Austin et al. |
| 3,579,941 | A | 5/1971 | Tibbals |
| 3,642,511 | A | 2/1972 | Cohn et al. |
| 3,652,360 | A | 3/1972 | Hartman et al. |
| 3,728,209 | A | 4/1973 | Sugaike et al. |
| 3,828,504 | A | 8/1974 | Egerborg et al. |
| 3,879,248 | A | 4/1975 | Kest |
| 3,956,563 | A | 5/1976 | Spang et al. |
| 3,960,580 | A | 6/1976 | Stierli et al. |
| 4,003,752 | A | 1/1977 | Osohata et al. |
| 4,112,176 | A | 9/1978 | Bailey |
| 4,117,197 | A * | 9/1978 | Krejci et al. ..... 428/443 |

(Continued)

FOREIGN PATENT DOCUMENTS

| | | |
|---|---|---|
| CA | 2219785 | 10/1996 |
| CN | 2134439 Y | 5/1993 |

(Continued)

OTHER PUBLICATIONS

English Language Abstract, JP Patent First Publication No. 09-203153, Aug. 5, 1997, (2 pages).

(Continued)

*Primary Examiner* — Jeremy Luks
(74) *Attorney, Agent, or Firm* — Haynes and Boone, LLP

(57) ABSTRACT

A material for use in building construction (partition, wall, ceiling, floor or door) that exhibits improved acoustical sound proofing and fire resistance. The material comprises a laminated structure having as an integral part thereof one or more layers of intumescent viscoelastic material which also functions as a glue, energy dissipating layer, and a fire resistive layer; and one or more constraining layers, such as gypsum, cement, metal, cellulose, wood, or petroleum-based products such as plastic, vinyl, plastic or rubber. In one embodiment, standard wallboard, typically gypsum, comprises the external surfaces of the laminated structure.

57 Claims, 20 Drawing Sheets

U.S. PATENT DOCUMENTS

| | | | | |
|---|---|---|---|---|
| 4,134,956 | A | 1/1979 | Suzuki et al. | |
| 4,156,615 | A | 5/1979 | Cukier et al. | |
| 4,174,229 | A | 11/1979 | Boberski et al. | |
| 4,195,713 | A | 4/1980 | Hagbjer et al. | |
| 4,259,220 | A | 3/1981 | Bunnelle et al. | |
| 4,311,767 | A | 1/1982 | Kennedy | |
| 4,347,912 | A | 9/1982 | Flocke et al. | |
| 4,364,017 | A | 12/1982 | Tokunaga et al. | |
| 4,375,516 | A | 3/1983 | Barrall | |
| 4,412,255 | A | 10/1983 | Kuhlman et al. | |
| 4,487,793 | A | 12/1984 | Haines et al. | |
| 4,488,619 | A | 12/1984 | O'Neill | |
| 4,557,970 | A | 12/1985 | Holtrop et al. | |
| 4,618,370 | A | 10/1986 | Green et al. | |
| 4,642,951 | A | 2/1987 | Mortimer | |
| 4,663,224 | A | 5/1987 | Tabata et al. | |
| 4,678,515 | A | 7/1987 | Green et al. | |
| 4,685,259 | A | 8/1987 | Eberhart et al. | |
| 4,719,261 | A | 1/1988 | Bunnelle et al. | |
| 4,759,164 | A | 7/1988 | Abendroth et al. | |
| 4,778,028 | A | 10/1988 | Staley | |
| 4,786,543 | A | 11/1988 | Ferm | |
| 4,791,044 | A | 12/1988 | Yoshino | |
| 4,806,703 | A | 2/1989 | Sims | |
| 4,924,969 | A | 5/1990 | K'Heureux | |
| 4,941,207 | A | 7/1990 | Maeda et al. | |
| 4,956,321 | A | 9/1990 | Barrall | |
| 4,965,408 | A | 10/1990 | Chapman et al. | |
| 4,967,530 | A | 11/1990 | Clunn | |
| 4,977,926 | A | 12/1990 | Hocking | |
| 5,016,413 | A | 5/1991 | Counihan | |
| 5,026,593 | A | 6/1991 | O'Brien | |
| 5,033,247 | A | 7/1991 | Clunn | |
| 5,063,098 | A | 11/1991 | Niwa et al. | |
| 5,110,660 | A | 5/1992 | Wolf et al. | |
| 5,125,475 | A | 6/1992 | Duchame et al. | |
| 5,143,790 | A | 9/1992 | Sattinger | |
| 5,158,612 | A | 10/1992 | Savoly et al. | |
| 5,240,639 | A | 8/1993 | Diez et al. | |
| 5,256,223 | A | 10/1993 | Alberts et al. | |
| 5,258,585 | A | 11/1993 | Juriga | |
| 5,283,998 | A * | 2/1994 | Jong | 52/515 |
| 5,304,415 | A | 4/1994 | Kurihara et al. | |
| 5,334,806 | A | 8/1994 | Avery | |
| 5,342,465 | A | 8/1994 | Bronowicki et al. | |
| 5,368,914 | A | 11/1994 | Barrett | |
| 5,439,735 | A | 8/1995 | Jamison | |
| 5,473,122 | A | 12/1995 | Kodiyalam et al. | |
| 5,474,840 | A | 12/1995 | Landin | |
| 5,496,966 | A | 3/1996 | Hightower et al. | |
| 5,502,931 | A | 4/1996 | Munir | |
| 5,535,920 | A | 7/1996 | Blair, Jr. et al. | |
| 5,585,178 | A | 12/1996 | Calhoun et al. | |
| 5,595,801 | A | 1/1997 | Fahy et al. | |
| 5,603,192 | A | 2/1997 | Dickson | |
| 5,629,503 | A | 5/1997 | Thomasen | |
| 5,643,666 | A | 7/1997 | Eckart et al. | |
| 5,644,880 | A | 7/1997 | Lehnert et al. | |
| 5,664,397 | A | 9/1997 | Holz | |
| 5,674,338 | A | 10/1997 | Parker et al. | |
| 5,691,037 | A | 11/1997 | McCutcheon et al. | |
| 5,695,867 | A | 12/1997 | Saitoh et al. | |
| 5,768,841 | A | 6/1998 | Swartz et al. | |
| 5,824,973 | A | 10/1998 | Haines et al. | |
| 5,827,609 | A | 10/1998 | Ercillo et al. | |
| 5,867,957 | A | 2/1999 | Holtrop | |
| 5,907,932 | A | 6/1999 | LeConte et al. | |
| 5,910,082 | A | 6/1999 | Bender et al. | |
| 5,918,437 | A * | 7/1999 | Dobija | 52/506.01 |
| 5,945,208 | A | 8/1999 | Richards et al. | |
| 5,945,643 | A | 8/1999 | Casser | |
| 5,954,497 | A | 9/1999 | Cloud et al. | |
| 6,077,613 | A | 6/2000 | Gaffigan | |
| 6,103,640 | A | 8/2000 | Yoshikawa et al. | |
| 6,123,171 | A | 9/2000 | McNett et al. | |
| 6,133,172 | A | 10/2000 | Sevenish et al. | |
| 6,213,252 | B1 | 4/2001 | Ducharme | |
| 6,238,594 | B1 * | 5/2001 | Turpin et al. | 252/389.2 |
| 6,240,704 | B1 | 6/2001 | Porter | |
| 6,266,427 | B1 | 7/2001 | Mathur | |
| 6,286,280 | B1 | 9/2001 | Fahmy et al. | |
| 6,290,021 | B1 | 9/2001 | Standgaard | |
| 6,309,985 | B1 | 10/2001 | Virnelson et al. | |
| 6,342,284 | B1 | 1/2002 | Yu | |
| 6,381,196 | B1 | 4/2002 | Hein et al. | |
| 6,389,771 | B1 | 5/2002 | Moller | |
| 6,443,256 | B1 | 9/2002 | Baig | |
| 6,443,257 | B1 * | 9/2002 | Wiker et al. | 181/290 |
| 6,536,555 | B1 | 3/2003 | Kelsic et al. | |
| 6,632,550 | B1 | 10/2003 | Yu | |
| 6,672,426 | B2 | 1/2004 | Kakimoto et al. | |
| 6,676,744 | B2 | 1/2004 | Merkley et al. | |
| 6,699,426 | B1 | 3/2004 | Burke | |
| 6,715,241 | B2 | 4/2004 | Gelin et al. | |
| 6,747,074 | B1 * | 6/2004 | Buckingham et al. | 523/179 |
| 6,758,305 | B2 | 7/2004 | Gelin et al. | |
| 6,790,520 | B1 | 9/2004 | Todd et al. | |
| 6,790,525 | B2 | 9/2004 | Takeuchi et al. | |
| 6,800,161 | B2 | 10/2004 | Takigawa | |
| 6,803,110 | B2 | 10/2004 | Drees et al. | |
| 6,815,049 | B2 | 11/2004 | Veeramasuneni | |
| 6,822,033 | B2 | 11/2004 | Yu | |
| 6,825,137 | B2 | 11/2004 | Fu et al. | |
| 6,877,585 | B2 | 4/2005 | Tinianov | |
| 6,913,667 | B2 | 7/2005 | Nudo et al. | |
| 6,920,723 | B2 | 7/2005 | Downey | |
| 6,941,720 | B2 | 9/2005 | Deford et al. | |
| 7,012,190 | B1 | 3/2006 | Price | |
| 7,041,377 | B2 | 5/2006 | Miura et al. | |
| 7,068,033 | B2 | 6/2006 | Sellers et al. | |
| 7,160,610 | B2 | 1/2007 | Takeuchi et al. | |
| 7,181,891 | B2 | 2/2007 | Surace et al. | |
| 7,197,855 | B2 | 4/2007 | Della Pepa | |
| 7,254,894 | B1 | 8/2007 | Halpert | |
| 7,255,907 | B2 | 8/2007 | Feigin et al. | |
| 7,307,223 | B2 | 12/2007 | Tyson et al. | |
| 7,745,005 | B2 | 6/2010 | Tinianov | |
| 7,798,287 | B1 | 9/2010 | Surace et al. | |
| 7,874,402 | B2 | 1/2011 | Doneux et al. | |
| 7,883,763 | B2 | 2/2011 | Tinianov | |
| 7,908,818 | B2 | 3/2011 | Tinianov et al. | |
| 7,909,136 | B2 | 3/2011 | Surace et al. | |
| 7,921,965 | B1 | 4/2011 | Surace | |
| 8,028,800 | B2 | 10/2011 | Ravnaas | |
| 8,029,881 | B2 | 10/2011 | Surace et al. | |
| 8,181,417 | B2 | 5/2012 | Surace et al. | |
| 8,181,738 | B2 | 5/2012 | Tinianov | |
| 2002/0009622 | A1 * | 1/2002 | Goodson | 428/703 |
| 2002/0029929 | A1 | 3/2002 | Tinianov | |
| 2003/0006090 | A1 | 1/2003 | Reed | |
| 2003/0070367 | A1 | 4/2003 | Gelin et al. | |
| 2003/0102184 | A1 | 6/2003 | Brisson et al. | |
| 2003/0117787 | A1 | 6/2003 | Nakauchi | |
| 2003/0125447 | A1 * | 7/2003 | Hoch et al. | 524/495 |
| 2003/0188826 | A1 | 10/2003 | Miller | |
| 2003/0232190 | A1 | 12/2003 | O'Leary et al. | |
| 2004/0016184 | A1 | 1/2004 | Huebsch et al. | |
| 2004/0087721 | A1 | 5/2004 | Bruhn et al. | |
| 2004/0168853 | A1 | 9/2004 | Gunasekera et al. | |
| 2004/0177590 | A1 | 9/2004 | Nudo et al. | |
| 2004/0213973 | A1 | 10/2004 | Hara et al. | |
| 2004/0214008 | A1 | 10/2004 | Dobrusky et al. | |
| 2005/0040825 | A1 | 2/2005 | Sellers et al. | |
| 2005/0050846 | A1 * | 3/2005 | Surace et al. | 52/782.1 |
| 2005/0080193 | A1 | 4/2005 | Wouters et al. | |
| 2005/0103568 | A1 | 5/2005 | Sapoval et al. | |
| 2005/0130541 | A1 | 6/2005 | Shah | |
| 2005/0136276 | A1 | 6/2005 | Borup et al. | |
| 2006/0048682 | A1 | 3/2006 | Wagh et al. | |
| 2006/0057345 | A1 | 3/2006 | Surace et al. | |
| 2006/0059806 | A1 | 3/2006 | Gosling et al. | |
| 2006/0108175 | A1 | 5/2006 | Tinianov et al. | |
| 2006/0124388 | A1 | 6/2006 | Pompei | |
| 2006/0260272 | A1 | 11/2006 | Swiszcz et al. | |
| 2007/0094950 | A1 | 5/2007 | Surace et al. | |
| 2007/0102237 | A1 | 5/2007 | Baig | |
| 2007/0107350 | A1 | 5/2007 | Surace et al. | |

| | | | |
|---|---|---|---|
| 2007/0175173 | A1 | 8/2007 | Babineau, Jr. et al. |
| 2008/0251198 | A1 | 10/2008 | Tinianov |
| 2008/0264721 | A1 | 10/2008 | Tinianov et al. |
| 2009/0000245 | A1 | 1/2009 | Tinianov et al. |
| 2009/0000866 | A1 | 1/2009 | Tinianov |
| 2009/0004448 | A1 | 1/2009 | Tinianov |
| 2009/0107059 | A1 | 4/2009 | Kipp et al. |
| 2009/0239429 | A1 | 9/2009 | Kipp et al. |
| 2009/0280356 | A1 | 11/2009 | Tinianov et al. |
| 2010/0047461 | A1 | 2/2010 | Colbert |
| 2010/0116405 | A1 | 5/2010 | Kipp et al. |
| 2010/0170746 | A1 | 7/2010 | Restuccia et al. |
| 2010/0230206 | A1 | 9/2010 | Tinianov |
| 2011/0061324 | A1 | 3/2011 | Tinianov |
| 2011/0165429 | A1 | 7/2011 | Tinianov et al. |

FOREIGN PATENT DOCUMENTS

| | | | | |
|---|---|---|---|---|
| CN | 1358684 | A | | 7/2002 |
| CN | 1358684 | A | | 7/2002 |
| CN | 1894474 | A | | 1/2007 |
| EP | 0412816 | A | | 2/1991 |
| EP | 1154087 | B1 | | 11/2001 |
| EP | 1388836 | A | | 2/2004 |
| JP | 2-117825 | A | | 5/1990 |
| JP | 06-250669 | A | | 9/1994 |
| JP | 07-506158 | A | | 7/1995 |
| JP | 08-156173 | A | | 6/1996 |
| JP | 09-203153 | | | 8/1997 |
| JP | 09203153 | A | * | 8/1997 |
| JP | 10-054096 | A | | 2/1998 |
| JP | 11-219186 | A | | 8/1999 |
| JP | 2001-522751 | A | | 11/2001 |
| JP | 2002-164690 | | | 6/2002 |
| JP | 2002-520544 | A | | 7/2002 |
| JP | 2003-071834 | A | | 3/2003 |
| WO | 93/21402 | A1 | | 10/1993 |
| WO | WO 96/34261 | | | 10/1996 |
| WO | WO 97/19033 | | | 5/1997 |
| WO | 99/24290 | A | | 5/1999 |
| WO | 00/02204 | A | | 1/2000 |
| WO | WO 00/24690 | | | 5/2000 |
| WO | 2007/055835 | A2 | | 5/2007 |

OTHER PUBLICATIONS

*A Study of Techniques to Increase the Sound of Insulation of Building Elements*, Wyle Laboratories, Prepared for Dept. of Housing and Urban Development, Jun. 1973 (16 pages).

*Field Sound Insulation Evaluation of Load-Beating Sandwich Panels for Housing*, Final Report, Prepared by Robert E. Jones, Forest Products Laboratory, Forest Service, U.S. Department of Agriculture, Aug. 1975 (53 pages).

*Sound Studio Construction on A Budget*, F. Alton Everest, McGraw-Hill, 1997 (7 pages).

*Wood Handbook/Wood as an Engineering Material*, United States Department of Agriculture, Forest Service, General Technical Report FPL-GTR-113, Mar. 1999 (24 pages).

*Transmission Loss of Plasterboard Walls* by T. D. Northwood, Building Research Note, Division of Building Research, National Research Counsel, Ottawa, Canada (10 pages).

*A Guide to Airborne, Impact, and Structureborne Noise Control in Multifamily Dwellings*, U. S. Department of Housing and Urban Development, Prepared for the National Bureau of Standards, Washington, D. C., Jan. 1963 (5 pages).

*Transmission Loss of Leaded Building Materials*, Paul B. Ostergaard, Richmond L. Cardinell, and Lewis S. Goodfriend, The Journal of the Acoustical Society of America, vol. 35, No. 6, Jun. 1963 (7 pages).

*Dictionary of Architecture & Construction 2200 illustrations*, Third Edition, Edited by Cyril M. Harris, Professor Emeritus of Architecture Columbia University, McGraw-Hill, 2000 (7 pages).

*Dictionary of Engineering Materials*, Harald Keller, Uwe Erb, Wiley-Interscience by John Wiley & Sons, Inc. 2004 (4 pages).

*Chamber Science and Technology Dictionary*, by Professor Peter M. B. Walker, W & R Chambers Ltd and Cambridge University Press, 1988 (3 pages).

International Search Report and Written Opinion dated Jan. 15, 2009.

Noise and Vibration Control Engineering: *Principles and Applications*, Edited by Leo Beranek and Instvan Ver, Chapter 11, John Wiley & Sons, Inc., 1002, (12 pages).

Handbook of *Acoustical Measurements and Noise Control*, Edited by Cyril Harris, Chapter 32; Structureborne Sound Isolation, Chapter 33; Noise Control in Buildings, McGraw-Hill, Inc., 1991, (36 pages).

"Green Glue is your soundproofing solution and noise reduction material", www.greengluecompany.com (2 pages).

Acoustical: *A Sound Approach to Testing*, www.archest.com/pages (2 pages).

STC—*Sound Transmission Class—Discussion and Use*, www.sota.ca/stc_info.htm (3 pages).

ASTM International, Designation: C 1396/C 1396M-04, *Standard Specification for Gypsum Board* (7 pages).

Barbara C. Lippiatt, National Institute of Standards and Technology. BEES 3.0, "*Building for Environmental and Economic Sustainability* Technical Manual and User Guide", Oct 2002, (198 pages).

Takada, et al., *Effect in Reducing Floor Impact Noise of Recycled Paper Damper Members*, Bulletin of Tokyo Metropolitan Industrial Technology Research Institute, No. 2 (1999) [certified English translation] (13 pages).

*Architectural Acoustics*, M. David Egan, J. Ross Publishing (Reprint 2007) p. 211; originally published McGraw-Hill, 1988 (5 pages).

Hastings, Mardi C.; Godfrey, Richard; Babcock, G. Madison, *Application of Small Panel Damping Measurements to Larger Walls*, Proc. SPIE vol. 2720, p. 70-76, Smart Structures and Materials 1996: Passive Damping and Isolation (7 pages).

van Vuure, A. W.; Verpoest, I., Ko, F.K., *Sandwich-Fabric Panels as Spacers in a Constrained Layer Structural Damping Application*, Composites Part B 32 (2001) 11-19, Elsevier Science Ltd. (9 pages).

Noise and Vibration Control, Revised Edition, pp. 306-315, Institute of Noise Control Engineering, 1988, Beranek, Leo L. (editor) (9 pages).

Noise and Vibration Control, Chapter Fourteen, *Damping of Panels*, Ungar, Eric E., pp. 434-473, McGraw-Hill, 1971, Beranek, Leo L. (editor) (7 pages).

Noise and Vibration Control Engineering, *Principles and Application*, pp. 466-479, John Wiley & Sons, 1992, Beranek, Leo L. and Ver, Istvan L. (editors) (9 pages).

Nashif, Ahid D.; Jones, David I. G.; Henderson, John P., *Vibration Damping*, pp. 290-305, John Wiley & Sons, 1985 (18 pages).

Architectural Acoustics, Principles and Practice, John Wiley & sons, 1992, Cavanaugh, William J. and Wilkes, Joseph A. (editors) (332 pages).

FIRE Resistance Design Manual, Sound Control, Gypsum Association, GA-600-94 ($14^{th}$ Ed.) (107 pages).

FIRE Resistance Design Manual, Sound Control, Gypsum Association, GA-600-97 ($15^{th}$ Ed.) (120 pages).

FIRE Resistance Design Manual, Sound Control, Gypsum Association, GA-600-2000 ($16^{th}$ Ed.) (139 pages).

Noxon, Arthur M., *The Chain Is as Strong as its Weakest Link*, An article written for the first Hong Long HiFi Show, 1993, Translated and Published in Chinese, http://www.acousticsciences.com/articles/chain.htm (7 pages).

*Quiet Lightweight Floor Systems*, Reprint from Sound and Vibration Magazine, Jul. 1992, by David A. Harris, Building & Acoustic Design Consultants (7 pages).

Joyal, Brian, *Constrained-Layer Systems Provide Weight-Efficient, High Level Damping* (4 pages).

Dynamat materials http://web.archive.org/web/20010525113753/www.admteschusa.com/Dynamat.html Jun. 12, 2007, ADM Tech—Dynamic Control (15 pages).

Noise Killer: Pro Damping Compound Materials http://www.tnt-audio.com/clinica/noise.html May 18, 2007, 1998 (3 pages).

Waybackmachine search results for Jan 1, 1996—Jun. 12, 2007 (1 page).

Frankovich, David, *The Four-Fold Method of Noise and Vibration Control* (8 pages).

Renninger, Jennifer, *Understanding Damping Techniques for Noise and Vibration Control* (8 pages).

Unified Facilities Criteria (UFC) *Noise and Vibration Control*, UFC 3-450-01. 15 May 200, Department of Defense (156 pages).

United States Gypsum, *Architectural and Construction Services, Design Data for Acousticians*, Feb. 1986 (4 pages).
*A Study of Techniques to Increase the Sound of Insulation of Building Elements*, Wyle Laboratories, Prepared for Dept. of Housing and Urban Development, Jun. 1973 (12 pages).
dB-Ply materials Sound Reducing Panels from Greenwood Forest Products, Inc., Apr. 24, 1997 (9 pages).
dB-Rock materials OMNI Products, Inc. (3 pages).
ASC WallDamp materials from Acoustic Sciences Corporation http://web.archive.org/web/20021013031149/www.asc-soundproof.com/index-walldamp . . . May 18, 2007 (21 pages).
Sounddown Viscoelastic Glue DG-A2, Soundown Corporation (2 pages).
Nordisk Akustik A/S materials, http://web.archive.org/web/200206240933724/www.nordisk-akustik.dk/html_uk/prod03.ht . . . Jun. 11, 2007 (4 pages).
IES 2000 *Dampening and Visocelastic Membranes* (Jul. 2, 2003) Atlanta.com/product (pp. 1-6).
Waybackmachine search results for Jan 1, 1996-May 3, 2006 (1 page).
"*Damping of plate flexural vibrations by means of viscoelastic laminae*" by D. Ross, E.E. Ungar, and E.M. Kerwin—Structural Damping, Section III, ASME, 1959, New York (41 pages).
Vandersall , H. L., "*Intumescent Coating Systems, Their development and Chemistry*" J. Fire & Flammability, vol. 2 (Apr. 1971) pp. 97-140 (45 pages).
International Search Report and Written Opinion for International Application No. PCT/US10/36411 dated Jul. 27, 2010.
M.N. Darrouj et al., "Optimum Design of Constrained Layer Damping Panels", Materials & Design, vol. 10, No. 4, pp. 202-208, Jul.-Aug. 1989.
Z. Xie et al., "An enhanced beam model for constrained layer damping and a parameter study of damping contribution", Journal of Sound and Vibration, vol. 319, Issues 3-5, pp. 1271-1284, Jan. 23, 2009.
G. Lepoittevin et al., "Optimization of segmented constrained layer damping with mathematical programming using strain energy analysis and modal data", Materials & Design, vol. 31, Issue 1, pp. 14-24, Jan. 2010.
D.I.G. Jones, *Handbook of Viscoelastic Vibration Damping*, John Wiley and Sons, pp. 284-297, Aug. 2001.
Pritz. "Loss Factor Peak of Viscoelastic Materials: Magnitude to Width Relations", J. of Sound and Vibration, 246(2): 265-280, 2001.
Creton, Costantino, "Pressure-Sensitive Adhesives: An Introductory Course", *MRS Bulletin*, Jun. 2003, pp. 434-439. www.mrs.org/publications/bulletin.
International Search Report and Written Opinion in corresponding International Application No. PCT/US08/68861 dated Sep. 5, 2008.
International Search Report and Written Opinion in corresponding International Application No. PCT/US08/68863 dated Sep. 17, 2008.
International Search Report and Written Opinion in corresponding International Application No. PCT/US08/68676 dated Sep. 25, 2008.
Japanese Office Action dated May 12, 2009 for corresponding Japanese Application No. 2006-525373, English Translation.
Japanese Office Action dated Dec. 22, 2009 for corresponding Japanese Application No. 2006-525373, English Translation.
Chinese Office Action dated Dec. 26, 2008 for corresponding Chinese Application No. 200480032594.9, English Translation.
Supplementary European Search Report dated Mar. 24, 2009 for corresponding European Application No. 04782564.1.
Spec-Data Quiet Solution Datasheet, Reed Construction Data, (2005).
Armstrong Basic Drywall Grid Installation Guide, http://web.archive.org/web/*/http://www.armstrong.com/common/c2002/content/files/4279.pdf. (Original Publication Date May 30, 2005, Retrieved Aug. 19, 2008).
International Search Report and Written Opinion in corresponding International Application No. PCT/US08/59960 dated Aug. 1, 2008.
www.acousticalsolutions.com/products/pdfs/install_green_glue.pdf. accessed Nov. 5, 2009. web date Jun. 19, 2006.
Cheng et al. "Vibration Attenuation of Panel Structures by Optimally Shaped Viscoelastic Coating with Added Weight Considerations". Thin-Walled Structures, 21 (1995), pp. 307-326.
AVS Forum "Green Glue(R)", http://www.avsforum.com/avs-vb/archive/index.php/t-456614-p-2.html. retrieved Jul. 19, 2010, 4 pages total.
International Search Report and Written Opinion for International Application No. PCT/US10/50272 dated Nov. 15, 2010.
Wikipedia: the free encyclopedia, Hot-dip galvanizing, http://en.wikipedia.org/wiki/Galvanized_steel.
Supplementary European Search Report, Application No. EP 06827584.1, dated Nov. 4, 2009.
International Search Report and Written Opinion for International Application No. PCT/US06/43247 dated Dec. 5, 2007.
International Search Report and Written Opinion for International Application No. PCT/US08/59540 dated Aug. 15, 2008.
PCT International Search Report (ISR) and the Written Opinion mailed May 3, 2012, in related International Application No. PCT/US2012/022073.
Chinese Office Action dated Feb. 23, 2012 for corresponding Chinese Application No. 200980115534.6, English Translation.
PCT International Search Report (ISR) and the Written Opinion mailed Jul. 7, 2009, in related International Application No. PCT/US2009/043373.

* cited by examiner

ACOUSTICAL SOUND PROOFING MATERIAL WITH IMPROVED FIRE RESISTANCE AND METHODS FOR MANUFACTURING SAME

BACKGROUND

Noise control and moisture management constitute two rapidly growing economic and public policy concerns for the construction industry. Areas with high acoustical isolation (commonly referred to as 'soundproofed') are requested and required for a variety of purposes. Apartments, condominiums, hotels, schools and hospitals all require rooms with walls, ceilings and floors that reduce the transmission of sound thereby minimizing, or eliminating, the disturbance to people in adjacent rooms. Soundproofing is particularly important in buildings adjacent to public transportation, such as highways, airports and railroad lines. Additionally theaters, home theaters, music practice rooms, recording studios and others require increased noise abatement. Likewise, hospitals and general healthcare facilities have begun to recognize acoustical comfort as an important part of a patient's recovery time. One measure of the severity of multi-party residential and commercial noise control issues is the widespread emergence of model building codes and design guidelines that specify minimum Sound Transmission Class (STC) ratings for specific wall structures within a building. Another measure is the broad emergence of litigation between homeowners and builders over the issue of unacceptable noise levels. To the detriment of the U.S. economy, both problems have resulted in major builders refusing to build homes, condos and apartments in certain municipalities; and in widespread cancellation of liability insurance for builders. The International Code Council has established that the minimum sound isolation between multiple tenant dwellings or between dwellings and corridors is a lab certified STC 50. Regional codes or builder specifications for these walls are often STC 60 or more.

In addition the issue of noise control, fire resistance is an equally important construction industry concern. In fact, the primary objective of today's model building codes is ensuring that building occupants are safe from fire. The model building codes such as that of the International Code Council (ICC) or the National Fire Protection Association (NFPA) are written so that buildings will protect occupants who aren't intimate with the initial fire development for as long as they need to evacuate, relocate, or defend themselves in place. Buildings are also designed to provide firefighters and emergency responders with a reasonable degree of safety during search and rescue operations, and reasonably protect people near the fire from injury and death. Finally, the codes intend to protect adjacent buildings from substantial damage during a fire. These building codes use fire resistance to create safe structures in a strategy is known as compartmentation. The concept is to prevent a fire from spreading from the compartment of origin to an adjacent compartment for a prescribed length of time. For this purpose, a compartment can be defined in many ways: such as the occupied rooms of multi-family dwellings; as an entire building or some portion of a building (e.g. one floor in a high-rise); or as a single room like a hotel room. Buildings with mixed or multiple occupancies may be divided either vertically or horizontally into separate occupancies by fire-resistance-rated construction.

It is obvious that the problem is compounded when a single wall or structure needs to effectively both abate high noise levels and offer superior fire resistance.

For example, a traditional method for ensuring the fire resistance of a wall assembly is though the use of multiple layers of specially formulated gypsum wallboard. This wallboard, termed type X by the manufacturer, has a high density core reinforced with fiberglass fibers and sold in typical thicknesses of ⅝ inch and 1 inch. Major US manufacturers of type X gypsum include United States Gypsum of Chicago, Ill., National Gypsum of Charlotte, N.C., Georgia Pacific of Atlanta, Ga. and Lafarge of Paris, France. The conflict in the two requirements is evident in the case of many typical wood framed wall assemblies. A single stud wall assembly with a single layer of type X gypsum wallboard on each side is recognized as having a one-hour rating. Similarly, a single stud wall assembly with two layers of type X gypsum wallboard per side has a two-hour fire resistance rating. Unfortunately, while these example walls may meet or exceed the fire resistance requirements of the applicable building code, their acoustical performance is inadequate. That same single stud wall with a single layer of type X gypsum wallboard has been laboratory tested to an STC 34—well below code requirements. A similar wall configuration consisting of two layers of type X gypsum wall board on one side and a single layer of type X gypsum board on the other is an STC 36—only a slightly better result. Obviously, type X gypsum wallboard is an excellent fire resistive element, but a poor acoustical material. Other systems for improving the acoustical performance do exist, including mass loaded vinyl, resilient channels, and sound isolating clips. However, these techniques only add steps and materials to the assembly and do not contribute in any way to the final assembly's fire resistance.

Accordingly, what is needed is a new material and a new method of construction to reduce the transmission of sound from a given room to an adjacent area while simultaneously providing adequate fire resistance.

SUMMARY OF THE INVENTION

A figure of merit for the sound attenuating qualities of a material or method of construction is the material's Sound Transmission Class (STC). The STC numbers are ratings which are used in the architectural field to rate partitions, doors and windows for their effectiveness in reducing the transmission of sound. The rating assigned to a particular partition design is a result of acoustical testing and represents a best fit type of approach to a set of curves that define the sound transmission class. The test is conducted in such a way as to make measurement of the partition independent of the test environment and gives a number for the partition performance only. The STC measurement method is defined by ASTM E90 "Standard Test Method Laboratory Measurement of Airborne Sound Transmission Loss of Building Partitions and Elements," and ASTM E413 "Classification for Sound Insulation," used to calculate STC ratings from the sound transmission loss data for a given structure. These standards are available on the Internet at http://www.astm.org.

A figure of merit for the measurement of the fire resistance of a material or method of construction, is its fire resistance rating as measured in minutes (or hours) of time. The ASTM E119, "Standard Test Methods for Fire Tests of Building Construction and Materials" is conducted using a furnace with opening dimensions of approximately 9 feet high by 12 feet wide (2.77 m×3.7 m). The assembly is installed onto the open face of the furnace and loaded to its design capacity. The furnace temperature is regulated along a standard time-temperature curve. The test starts at room temperature and then rises to 1,000° F. (540° C.) at 5 minutes, 1,300° F. (705° C.) at 10 minutes, 1,700° F. (9250° C.) at one hour, and 1,850° F.

(1,010° C.) at two hours. The test is terminated and the rating time established when one of the following events occurs: hot gases passing through the assembly ignite cotton waste; thermocouples on top of the assembly show a temperature rise averaging 250° F. (140° C.); a single rise of 325° F. (180° C.) is achieved; the assembly collapses. The E119 test of doors and ceilings is similar to the wall test. In the case of a ceiling test, a horizontal furnace is used. Reference is sometimes made to Underwriter Laboratories Test Standards in both Canada and the United States, but these standards are identical to E119 in all important features.

The building codes require fire-resistance ratings, depending on area and height of building, the type of construction, and the intended occupancy. When fire resistance is required for combustible assemblies, the ratings are usually one hour in the United States and either 45 minutes or one hour in Canada. Data presented hereinafter was taken using the ASTM E119 method modified for small scale test samples. Further information may be found on the Internet at http://www.astm.org.

In accordance with the present invention, a new laminated structure and associated manufacturing process are disclosed which significantly improves the ability of a wall, ceiling, floor or door to resist the penetration of a fire while simultaneously reducing the transmission of sound from one room to an adjacent room, or from the exterior to the interior of a room, or from the interior to the exterior of a room.

The material comprises a lamination of several different materials. In accordance with one embodiment, a laminated substitute for drywall comprises a sandwich of two outer layers of selected thickness gypsum board which are glued to each other, using an intumescent, sound dissipating adhesive wherein the sound dissipating adhesive is applied in a certain pattern to some or all of the interior surfaces of the two outer layers. In one embodiment, the glue layer is a specially formulated intumescent fire-resistive FE QuietGlue® adhesive, which is a viscoelastic material available from Serious Materials, 1250 Elko Drive, Sunnyvale, Calif. 94089. In addition to the typical chemicals that make up the fire-resistive FE QuietGlue® adhesive, additional fire retardant compounds are added to aid the formation of a char layer and increase the fire resistance of the laminated panel.

Formed on the interior surfaces of the two gypsum boards, the glue layer is about 1/16 inch thick. In one instance, a 4 foot×8 foot panel consisting of two 1/4 inch thick gypsum wall board panels laminated together using a 1/16 layer inch thick of glue has a total thickness of approximately 1/2 inch. When used in a standard single wood stud frame, the assembly has a fire resistance rating of approximately 41 minutes and an STC value of approximately 49. For comparison, a similar wall assembly constructed with 1/2 inch thick standard gypsum wallboard has a fire resistance rating of 27 minutes and an STC rating of approximately 34. The result is a reduction in noise transmitted through the wall structure of approximately 15 decibels and an increase of the fire resistance by 14 minutes compared to the same structure using common (untreated) gypsum boards of equivalent mass and thickness, and construction effort.

BRIEF DESCRIPTION OF THE DRAWINGS

This invention will be more fully understood in light of the following drawings taken together with the following detailed description in which.

DESCRIPTION OF SOME EMBODIMENTS

The following detailed description is meant to be exemplary only and not limiting. Other embodiments of this invention, such as the number, type, thickness, dimensions, area, shape, and placement order of both external and internal layer materials, will be obvious to those skilled in the art in view of this description.

The process for creating laminated panels in accordance with the present invention takes into account many factors: exact chemical composition of the glue; pressing process; and drying and dehumidification process.

Figure 1:
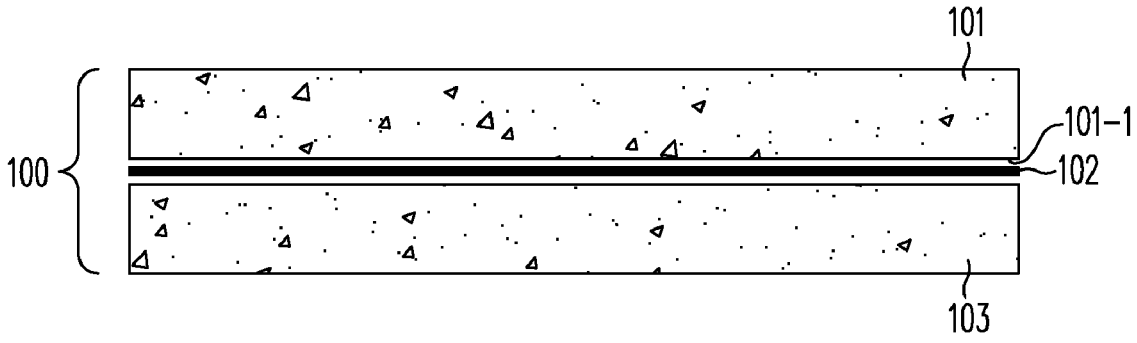
FIG. 1 shows a laminated structure fabricated in accordance with an embodiment of this invention for reducing the transmission of sound through the material while providing improved fire resistance.

FIG. 1 shows laminated structure 100 according to one embodiment of the present invention. In FIG. 1, the layers in the structure are described from top to bottom with the structure oriented horizontally as shown. It should be understood, however, that the laminated structure of this invention will be oriented vertically when placed on vertical walls and doors, as well as horizontally or even at an angle when placed on ceilings and floors. Therefore, the reference to top and bottom layers is to be understood to refer only to these layers as oriented in FIG. 1 and not in the context of the vertical use of this structure. In FIG. 1, reference character 100 refers to an entire laminated panel. A top layer 101 is made up of a standard gypsum material and in one embodiment is ¼ inch thick. Of course, many other combinations and thicknesses can be used for any of the layers as desired. The thicknesses are limited only by the acoustical attenuation (i.e., STC rating) and fire resistances (in minutes or hours) desired for the resulting laminated structure and by the weight of the resulting structure which will limit the ability of workers to install the laminated panels on walls, ceilings, floors and doors for its intended use.

The gypsum board in top layer 101 typically is fabricated using standard well-known techniques and thus the method for fabricating the gypsum board will not be described. Next, on the bottom surface 101-1 of the gypsum board 101 is a patterned layer of intumescent glue 102 called "Fire-Enhanced (FE) QuietGlue®" adhesive. Glue 102, made of a viscoelastic polymer doped with fire retardants, has the properties of sound dissipation and enhanced fire resistance. The layer 102 may have a thickness from about 1/64 inch to about ⅛ inch thickness although other configurations may be used. When energy in the sound interacts with the glue when constrained by surrounding layers, it will be significantly dissipated thereby reducing the sound's amplitude across a broad frequency spectrum. As a result, the energy of sound which will transmit through the resulting laminated structure is significantly reduced. Typically, glue 102 is made of the materials as set forth in TABLE 1, although other glues having similar characteristics to those set forth directly below Table 1 can also be used in this invention.

An important component of the glue composition and the overall laminated structure is the addition of intumescent compounds. Intumescent compositions are materials which, when heated above their critical temperature, will bubble and swell, thereby forming a thick non-flammable multi-cellular insulative barrier, up to 200 or more times their original thickness. When applied as intumescent coatings they can provide the protective, serviceable and aesthetic properties of non fire-retardant coatings or layers without occupying any additional initial volume. Intumescent coatings are discussed in detail in Intumescent Coating Systems, Their Development and Chemistry, H. L. Vandersall, J. Fire & Flammability, Vol. 2 (April 1971) pages 97-140, the content of which article is herein incorporated by reference.

Although the majority of commercially available intumescent coatings provide a substantially carbonaceous foam, it is within the scope of this invention to employ inorganic foaming mixtures, (e.g. phosphate/borate) mixtures, expandable graphite intercalation compounds, or a combination of both. The intumescent materials which may be employed in the practice of this invention should swell to at least about two times their original thickness when heated above their critical temperature.

Expandable graphite intercalation compounds are also known as expanding graphite and are commercially available. They are compounds, which contain foreign components intercalated between the lattice layers of the graphite. Such expandable graphite intercalation compounds usually are prepared by dispersing graphite particles in a solution, which contains an oxidizing agent and a guest compound, which is to be intercalated. Usually, nitric acid, potassium chlorate, chromic acid, potassium permanganate and the like are used as oxidizing agent.

TABLE 1

Fire-Enhanced (FE) Quiet Glue ® Adhesive Chemical Makeup

| | WEIGHT % | | |
|---|---|---|---|
| COMPONENTS | Min | Max | Preferred |
| acrylate polymer | 30 | 70 | 41 |
| ethyl acrylate, methacrylic acid, polymer with ethyl-2-propenoate | 0 | 3.0 | 0.3 |
| hydrophobic silica | 0 | 1.0 | 0.2 |
| paraffin oil | 0 | 3.0 | 1.5 |
| silicon dioxide | 0 | 1.0 | 0.1 |
| sodium carbonate | 0 | 3.0 | 0.6 |
| stearic acid, aluminum salt | 0 | 1.0 | 0.1 |
| surfactant | 0 | 2.0 | 0.6 |
| rosin ester | 0 | 20 | 7 |
| Zinc Borate | 0 | 25 | 12 |
| Melamine Phosphate | 0 | 10 | 6 |
| Ammonium Polyphosphate | 0 | 10 | 6 |
| Hexahydroxy methyl ethane | 0 | 5.0 | 1.5 |
| CI Pigment Red Dispersion | 0 | 1.0 | 0.02 |
| water | 10 | 40 | 23 |
| 2-Pyridinethiol, 1-oxide, sodium salt | 0 | 3.0 | 1 |

The preferred formulation is but one example of a viscoelastic glue. Other formulations may be used to achieve similar results and the range given is an example of successful formulations investigated here.

The physical solid-state characteristics of FE QuietGlue® adhesive include:

1) a broad glass transition temperature below room temperature;
2) mechanical response typical of a rubber (i.e., elongation at break, low elastic modulus);
3) strong peel strength at room temperature;
4) weak shear strength at room temperature;
6) does not dissolve in water (swells poorly);
7) peels off the substrate easily at temperature of dry ice; and
8) forms an expanding char layer when exposed to flame.

FE QuietGlue® adhesive may be obtained from Serious Materials, 1250 Elko Drive, Sunnyvale, Calif. 94089.

Gypsum board layer 103 is placed on the bottom of the structure and carefully pressed in a controlled manner with respect to uniform pressure (measured in pounds per square inch), temperature and time.

Finally, the assembly is subjected to dehumidification and drying to allow the panels to dry, typically for forty-eight (48) hours.

In one embodiment of this invention, the glue 102, when spread over the bottom surface 101-1 of top layer 101 or any other material, is subject to a gas flow for about forty-five seconds to partially dry the glue. The gas can be heated, in which case the flow time may be reduced. The glue 102, when originally spread out over any material to which it is being applied, is liquid. By partially drying out the glue 102, either by air drying for a selected time or by providing a gas flow over the surface of the glue, the glue 102 becomes a sticky paste much like the glue on a tape, commonly termed a pressure sensitive adhesive. The second panel, for example the bottom layer 103, is then placed over the glue 102 and pressed against the material beneath the glue 102 (as in the example of FIG. 1, top layer 101) for a selected time at a selected pressure. The gas flowing over the glue 102 can be, for example, air or dry nitrogen. The gas dehumidifies the glue 102, improving manufacturing throughput compared to the pressing process described previously wherein the glue 102 is not dried for an appreciable time prior to placing layer 103 in place.

In one embodiment the glue 102 is about $1/16^{th}$ of an inch thick, however other thicknesses may be used. The glue 102 may be applied with a brush, putty knife, caulking gun, sprayed on, applied using glue tape or other means.

Figure 2:
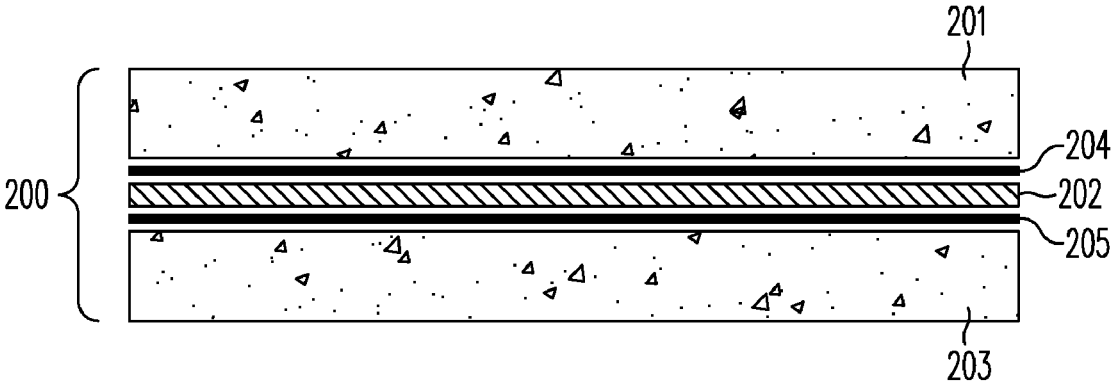
FIG. 2 shows an alternate embodiment of a laminated structure fabricated in accordance with another embodiment this invention for reducing the transmission of sound through the material while providing improved fire resistance.

In FIG. 2, laminated structure 200 includes two external layers of gypsum board 201 and 203 have on their interior faces glue layers 204 and 205, respectively. Between the two glue layers 204 and 205 is a constraining layer 202 made up of gypsum, vinyl, steel, wood, cement or another material suitable for the application. If layer 202 is vinyl, the vinyl is mass loaded and, in one embodiment, has a surface density of one pound per square foot or greater. Mass loaded vinyl is available from a number of manufacturers, including Technifoam, of Minneapolis, Minn. The constraining layer 202 may improve the sound attenuation and fire resistance characteristics of a laminated panel so constructed. The constraining layer 202 will, as do the glue areas 204 and 205, aid in the further resistance of the penetration of fire.

As a further example, constraining layer 202 can be galvanized steel of a thickness such as 30 gauge (0.012 inch thick). Steel has a higher Young's Modulus than vinyl and thus can outperform vinyl as an acoustic constraining layer. However, for other ease-of-cutting reasons, vinyl can be used in the laminated structure in place of steel. Cellulose, wood, plastic, cement or other constraining materials may also be used in place of vinyl or metal. The alternative material can be any type and any appropriate thickness. In the example of FIG. 2, the constraining material 202 approximates the size and shape of the glue layers 204 and 205 to which it is applied and to the outer panels 201 and 203.

In fabricating the structure of FIG. 1, the glue 102 is first applied in a prescribed manner, typically to a $1/16^{th}$ inch thickness, although other thicknesses can be used if desired, onto surface 101-1 of top layer 101. The bottom layer 103 is placed in contact with glue 102. Depending on the drying and dehumidification techniques deployed, anywhere from five minutes to thirty hours are required to totally dry the glue in the case that the glue is water-based. A solvent-based viscoelastic glue can be substituted.

In fabricating the structure of FIG. 2, the method is similar to that described for the structure of FIG. 1. In the embodiment of FIG. 2, exterior layers 201 and 203 are gypsum board having a thickness of 5/16 inch. However, before the bottom layer 203 is applied (bottom layer 203 corresponds to bottom layer 103) the constraining material 202 is placed over the location of the glue 204. A second layer of glue 205 is applied to the surface of the constraining material on the side of the constraining material that is facing away from the top layer 201. In one embodiment the glue layer 205 is applied to the interior side of bottom layer 203 instead of being applied to layer 202. The bottom layer 203 is placed over the stack of layers 201, 204, 202 and 905. The resulting structure allowed to set under a pressure of approximately two to five pounds per square inch, depending on the exact requirements of each assembly, although other pressures may be used as desired.

Figure 3:
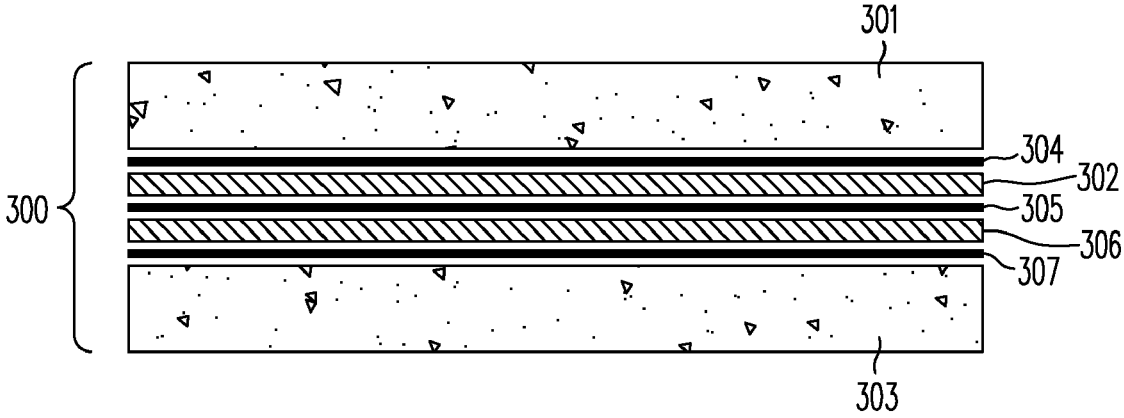
FIG. 3 shows another embodiment of a laminated structure fabricated in accordance with this invention for reducing the transmission of sound through the material while providing improved fire resistance.

FIG. 3 is an example of a third laminated panel 300 in which a second constraining layer 306 and a third glue layer 307 are added to the assembly shown in FIG. 2. Exterior layers 301 and 303 are gypsum board having a thickness of 1/4 inch. In fabricating laminated structure 300 of FIG. 3, the method is similar to that described for laminated structures 100 and 200 of FIG. 1 and FIG. 2, respectively. However, before the bottom layer 303 is applied (bottom layer 303 corresponds to bottom layers 103 and 203) a first constraining material 302 is placed over the location of the glue 304. Next, a second layer of glue 305 is applied to the surface of the constraining material on the side of the constraining material that is facing away from the top layer 301. An additional constraining layer 306 and glue layer 307 are placed on the assembly before the final layer 303 is added. In one embodiment the glue layer 305 is applied to the interior side of the second constraining layer 306. In one embodiment the glue layer 307 is applied to the interior side of the bottom layer 303 instead of being applied to layer 306. Suitable materials for constraining layers 302 and 306 are the same as those identified above for constraining layer 202. The bottom layer 303 is placed over the stack of layers 301, 304, 302, 305, 306, and 307. Laminated structure 300 is dried in a prescribed manner under a pressure of approximately two to five pounds per square inch, depending on the exact requirements of each assembly, although other pressures may be used as desired. Drying is typically performed by heating for a time from about 24 to about 48 hours and at a temperature in the range of from about 90° F. to about 120° F.

Figure 4:
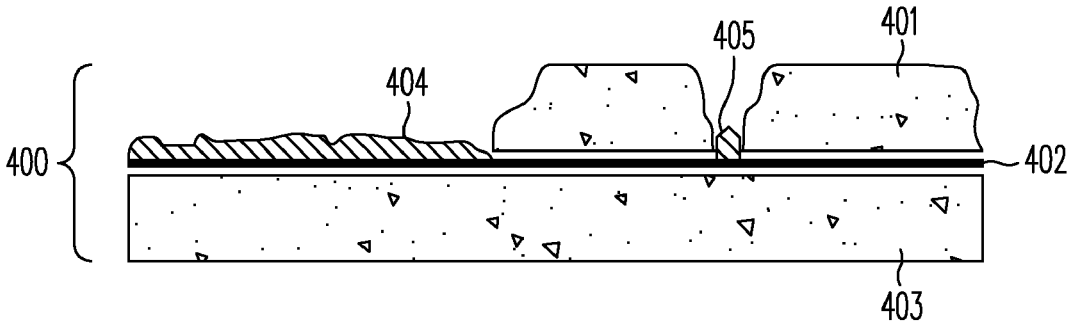
FIG. 4 shows a laminated structure similar to that shown in FIG. 1, but after extended exposure to fire. Areas of the fire-exposed panel to reveal areas of expanded intumescent glue.

FIG. 4 shows assembly 400, an embodiment of the laminated structure as shown in FIG. 1. In this figure, assembly 400 is in a damaged condition following extended exposure to fire. In this figure, the upper layer 401 represents a layer exposed to flame and temperatures in excess of 1,700° F. After an extended time period, layer 401 will crack and eventually fall away, as is typical of fire resistive materials such as gypsum wall board and cements. When glue layer 402 is exposed to temperatures greater than the on-set temperature, the glue expands and forms a fire resistive char layer. This expansion and char is indicated by reference characters 404 and 405.

Figure 5:
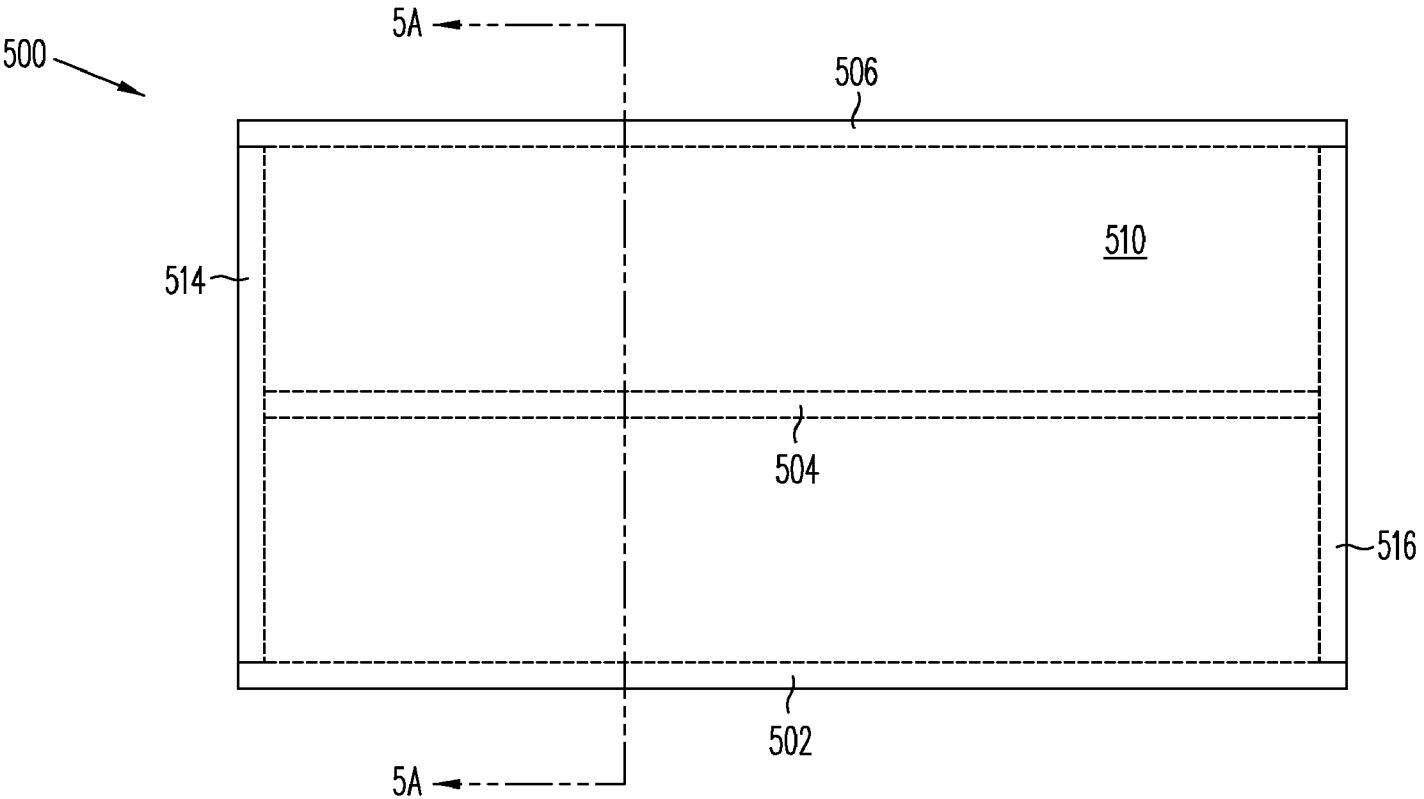
FIG. 5 is a plan view of a wall structure wherein one panel of the wall structure 500 comprises a laminated panel constructed in accordance with an embodiment of the present invention.
Figure 5A:
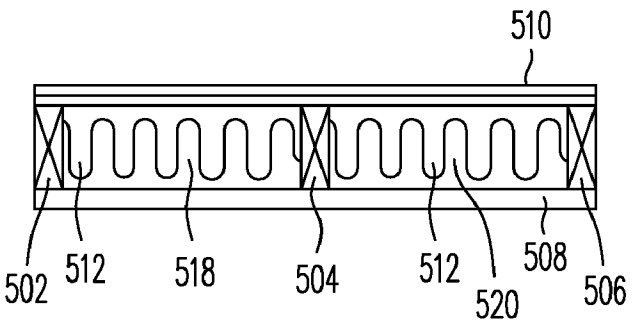
FIG. 5A is a cross sectional view taken along lines 5A-5A in FIG. 5

Referring to FIGS. 5 and 5A, wall assembly 500 is shown. This assembly includes a front side 510 which is constructed using a material such as that disclosed in FIG. 1, laminated structure 100, and a rear panel 508 which is a single layer of type X gypsum wallboard. Panels 508 and 510 are attached to studs 502, 504 and 506 and boards 514 and 516, all of which are 2×4 stud structures. These will be better appreciated by reference to the cross sectional view of FIG. 5A. Batt-type or blown-in thermal insulation 512 is located in each of cavities 518 and 520 which are enclosed between the 2×4 stud structures.

Figure 6:
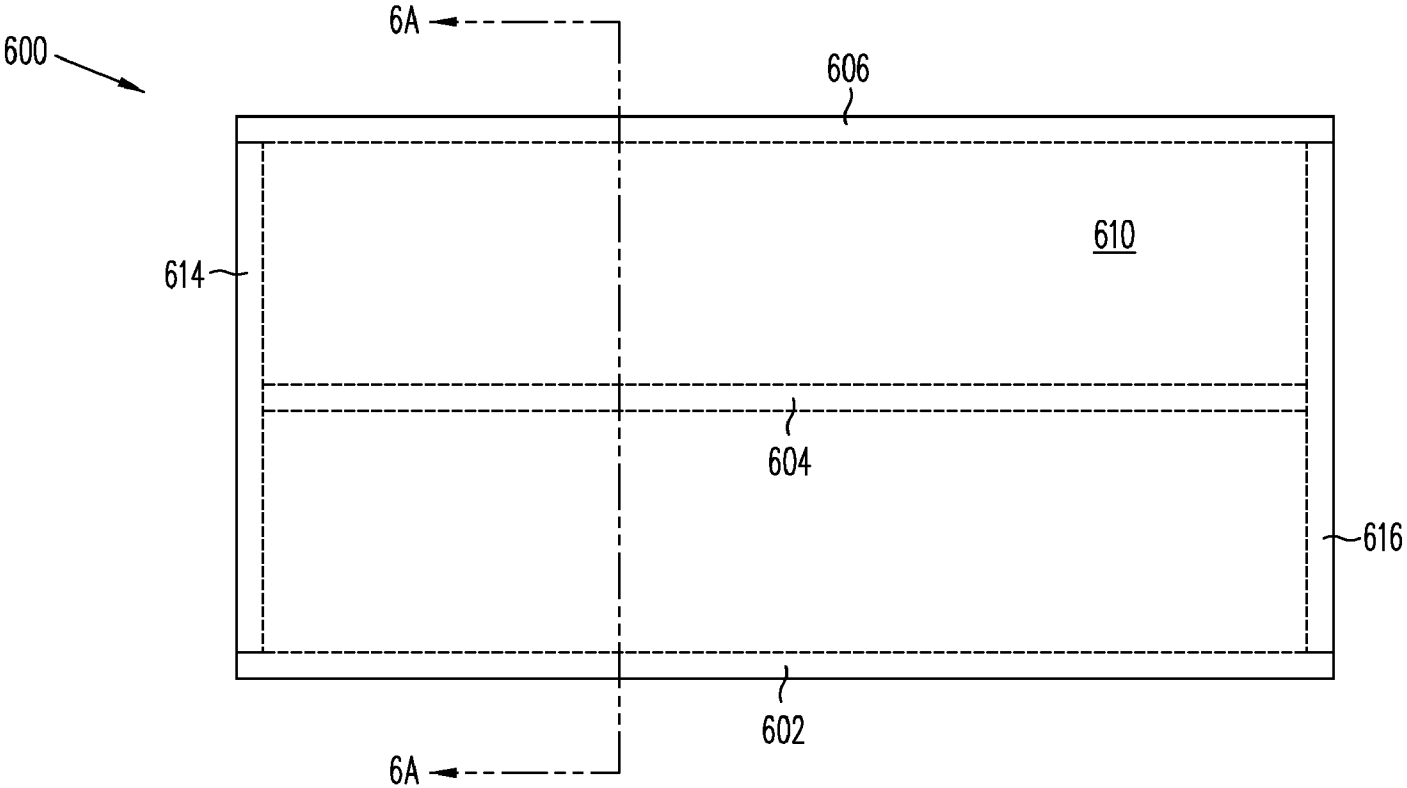
FIG. 6 is a plan view of a wall structure wherein two panels of the wall structure 600 include laminated panels constructed in accordance with the present invention.
Figure 6A:
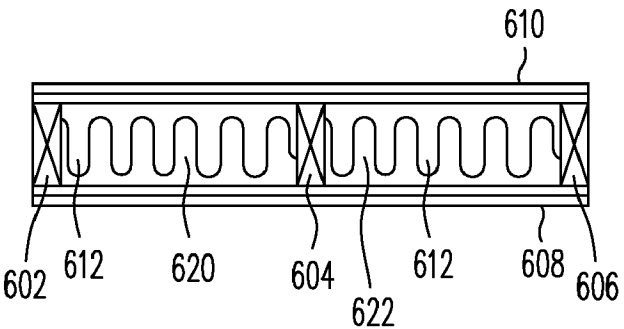
FIG. 6A is a cross view taken along lines 6A-6A in FIG. 6.

Referring to FIGS. 6 and 6A, wall panel 600 is disclosed and in this structure the front side 610 and the back side 608 are constructed using a laminated structure of one quarter inch gypsum board constructed using the laminated structure 100 shown in FIG. 1. As disclosed similarly with regard to FIGS. 5 and 5A, the wall panel assembly 600 includes 2×4 stud structures 602, 604, 606, 614 and 616 which are 2×4 stud structures. In a fashion similar to that show in FIG. 5A, cavities 620 and 622 include batt-type insulation 612. Since wall panel assembly 600 includes a laminated front and rear panels, an increased sound transmission class rating is provided and similarly additional fire resistance is also provided. As pointed out below in the discussion of FIG. 7, details of the results of fire resistance testing is provided.

Figure 7:
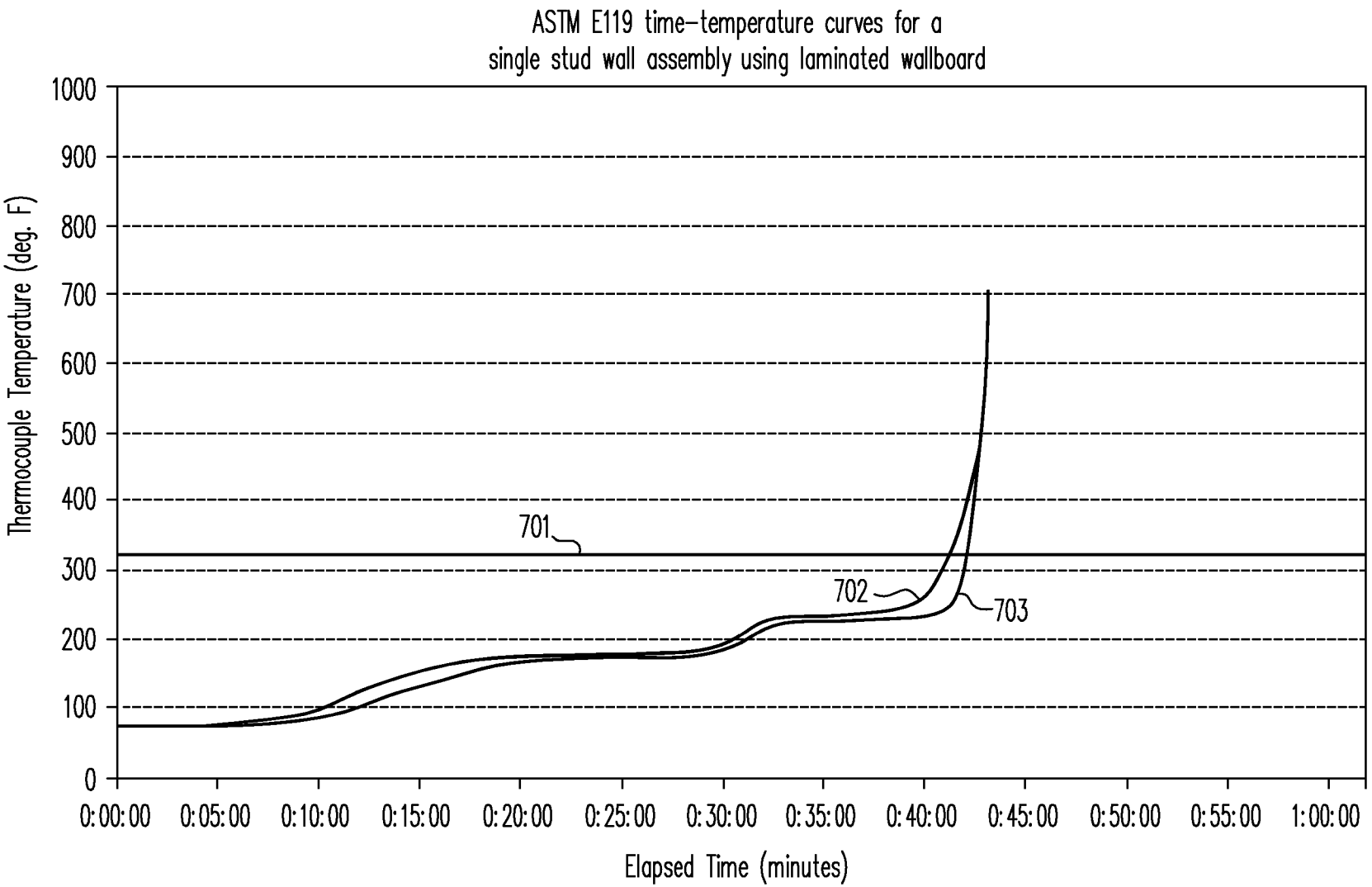
FIG. 7 shows detailed results data of a fire resistance test for an example embodiment of this invention.

FIG. 7 shows the results of fire resistance testing for structure 600 as in FIG. 6, wherein laminated panels 608 and 610 are constructed according to laminated panel 100 as shown in FIG. 1. In this example, laminated panels 608 and 610 include 1/4 inch gypsum wallboard 101, $1/16^{th}$ inch FE QuietGlue® adhesive 102 with fire retardants, and a bottom layer of 1 inch gypsum wallboard 103. The curves represent the measured temperature of two thermocouples mounted to the cold (unexposed) side of the wall structure. The test sample is said to fail at the time a thermocouple temperature is greater than 318° F. marked 701. For small scale tests, each sample has two thermocouples and the results are shown in traces 702 and 703. In this example, the wall structure failed at approximately 41 minutes.

Figure 8:
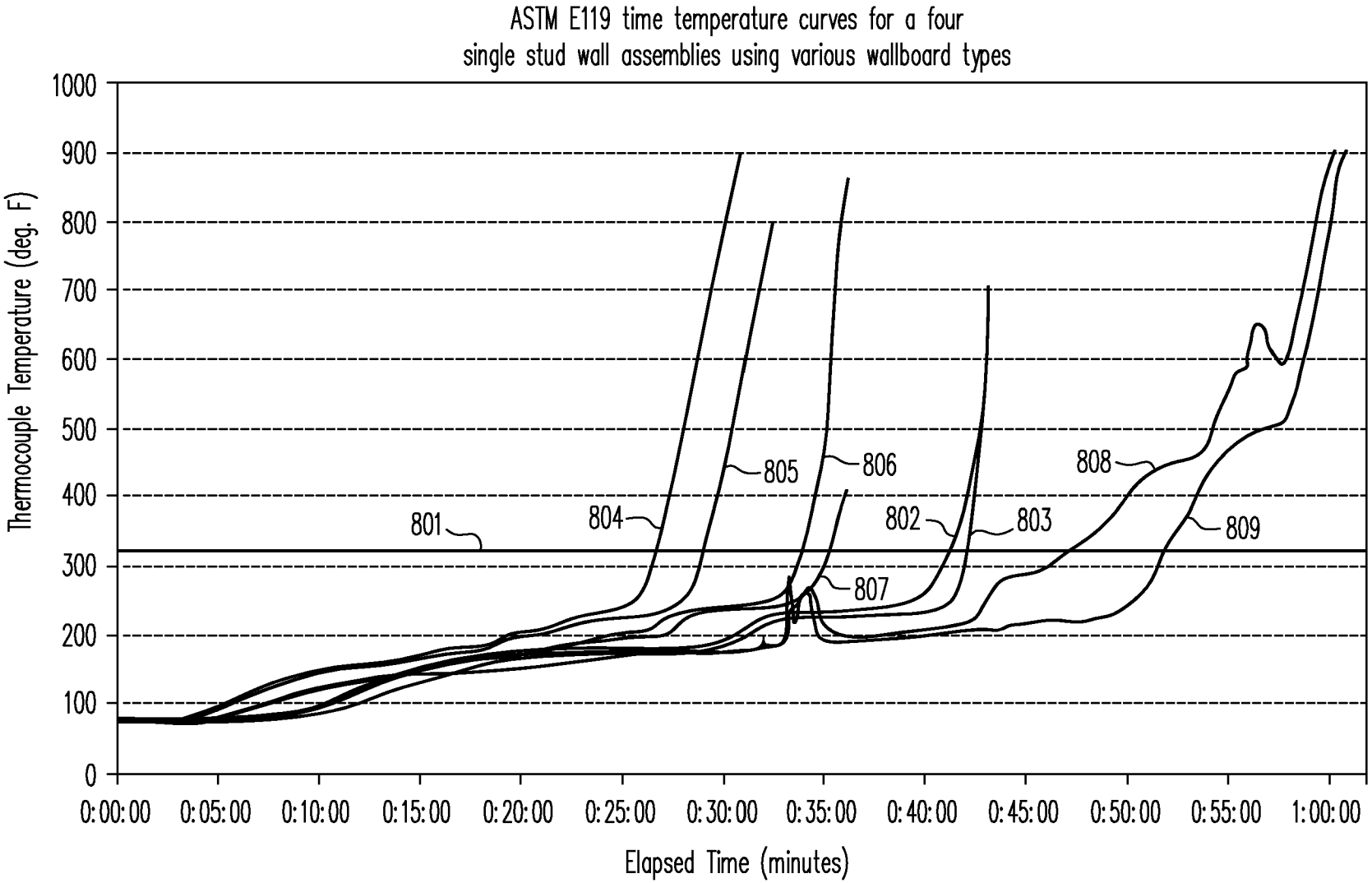
FIG. 8 shows detailed results data of multiple fire resistance tests for four example wall assemblies, including an embodiment of this invention.

FIG. 8 shows the temperature curves for eight total thermocouples mounted to four total wall structure test samples. Curves 804 and 805 represent the temperature curves for a wall structure similar to FIG. 6, but with ½ inch thick standard gypsum wallboard in laminated panels 608 and 610. The wall structure failed at approximately 27 minutes. Curves 808 and 809 represent the temperature curves for a wall structure similar to FIG. 6, but with ⅝ inch thick standard type X gypsum wallboard in laminated panels 608 and 610. The wall structure failed at approximately 48 minutes. Curves 806 and 807 represent the temperature curves for a wall structure as shown in FIG. 6, but with glue 102 containing no added intumescent compounds in parts 608 and 610. The wall structure failed at approximately 34 minutes. Curves 802 and 803 illustrate the temperature curves for a wall structure as shown in FIG. 6. In this assembly the glue 102 contains FE QuietGlue® adhesive with added intumescent compounds in parts 608 and 610. The wall structure failed at approximately 41 minutes.

Figure 9:
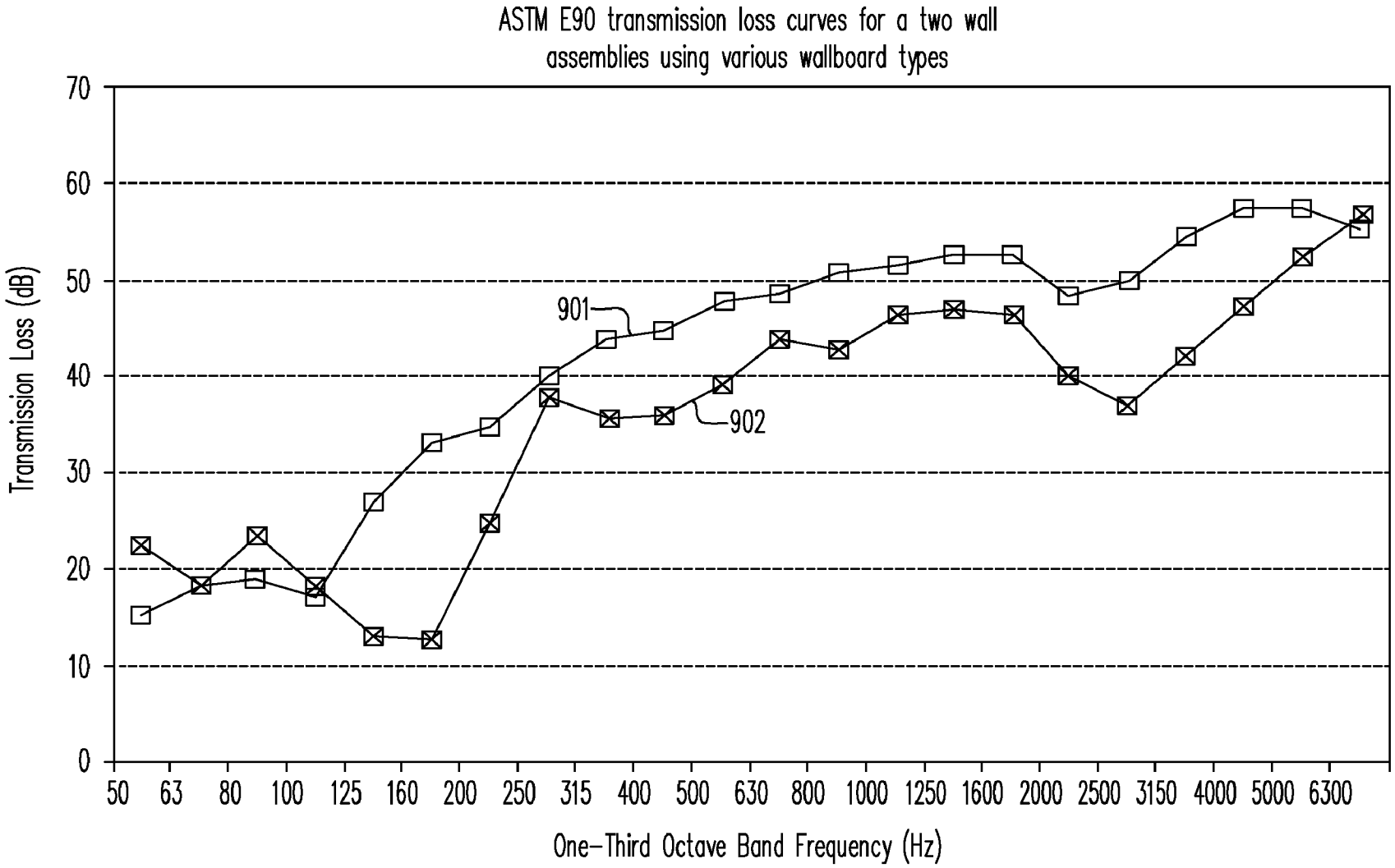
FIG. 9 shows detailed results data of multiple acoustical tests for four example wall assemblies, including an embodiment of this invention.

FIG. 9 compares the acoustical performance of a wall structure as shown in FIG. 5 to that of a similar wall structure with typical ⅝ inch thick gypsum wallboard instead of laminate 100. It is seen that the sound attenuation of the structure is significantly higher than the traditional wall assembly in all of the frequency bands of interest. Improvements such as these shown are typical of many wall structures including those with staggered stud frames, steel stud frames, and multiple wallboard layers. Curve 901 is the transmission loss for a wall structure as shown in FIG. 5. Its sound transmission class rating (STC) is 49. It is known to those practicing in this field that a similar configuration with standard ⅝ inch drywall on both sides of standard 2×4 stud construction yields an STC of approximately 34 as shown in curve 902. Accordingly, this invention yields a 15 STC point improvement over standard drywall in this particular construction.

Figure 10:
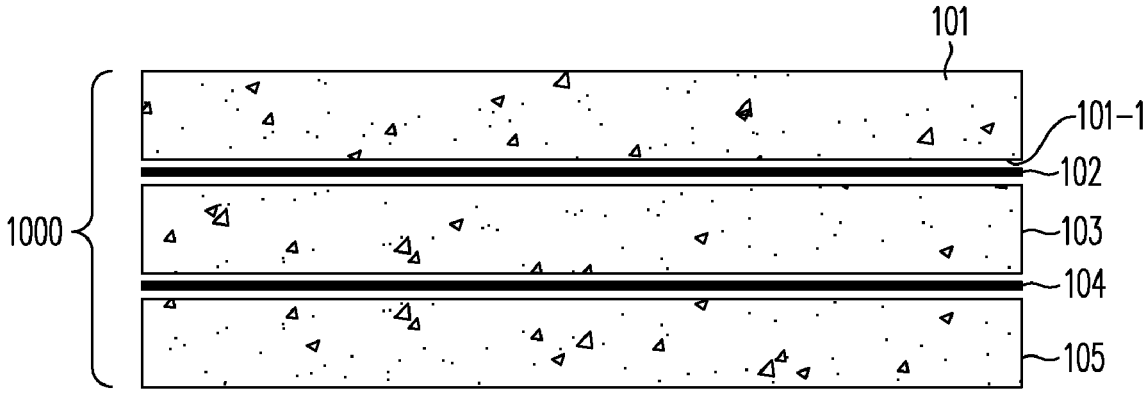
FIGS. 10, 11, 11A, 12, 12A, 13, 13A, 14, 14A, 15, 15A, 16, 16A, 17, 17A, 18, 18A, 19, 19A, 20, 20A, 21, 21A, 22, 22A, 23, 23A, 24, 24A, 25, 25A, 26, 26A, 27, 27A, 28, 28A, 29 and 29A show additional embodiments of the present invention.

An embodiment of the present invention is illustrated in FIG. 10 which illustrates laminated structure 1000. The common elements in FIG. 10 with those in FIG. 1 carry like reference characters. As shown in FIG. 10, an additional layer of FE QuietGlue® adhesive 104 is interposed between the lower surface of layer 103 and the upper surface layer of 105. The material for layer 105 may be another layer of gypsum board, or alternatively a layer of cement-based board, a layer of metal, a layer of wood, a layer of magnesium oxide-based board or a layer of calcium silicate board. The thickness of these boards may be, for example, as follows: gypsum board ¼ inch; cement based board ¼ inch; metal of a gauge such as 0.01 inch; wood ⅜ inch; magnesium oxide-based board ¼ inch; and calcium silicate board ¼ inch. Cement based boards are available from United States Gypsum of Chicago, Ill.; and James Hardie Industries NV of the Netherlands. Sheet steel may be sourced from AK Steel of Middletown, Ohio; California Steel Industries of Los Angeles, Calif.; Namasco Corp. of Roswell, Ga., and others. Calcium silicate based boards may be sourced from multiple manufacturers and suppliers including, Ningbo Yihe Green Board Co., Ltd. Of China; Zibo Xindi Refractory Co., Ltd. of China, and others. Cellulose based panels are available from Georgia Pacific, Atlanta, Ga.; Louisiana Pacific of Nashville Tenn., and others. Magnesium oxide panels are available from Magnum Building Products of Tampa, Fla., Technological Environmental Building Materials Co., Ltd. of China, Evernice Building Materials Co., Ltd. of China, and others. Other materials may be used for layer 105. With the laminated structure 1000 it will be appreciated of course that additional sound deadening is achieved as well as additional fire protection since the embodiment includes another layer of FE QuietGlue® adhesive, as well as another layer of material of the type noted above.

Figure 11:
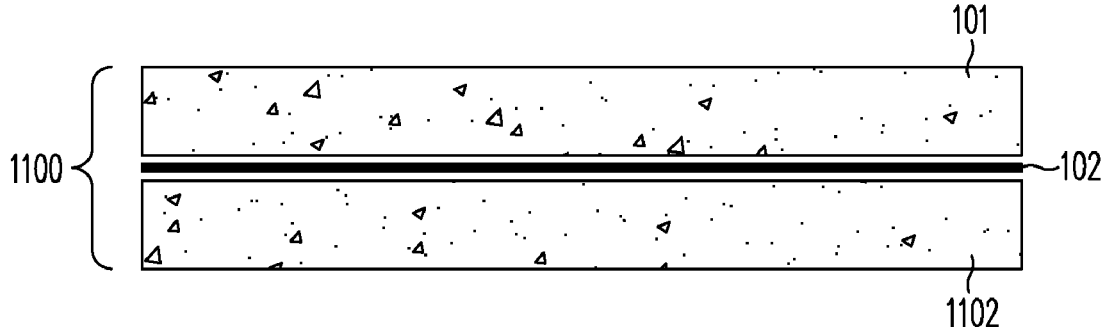
Figure 11A:
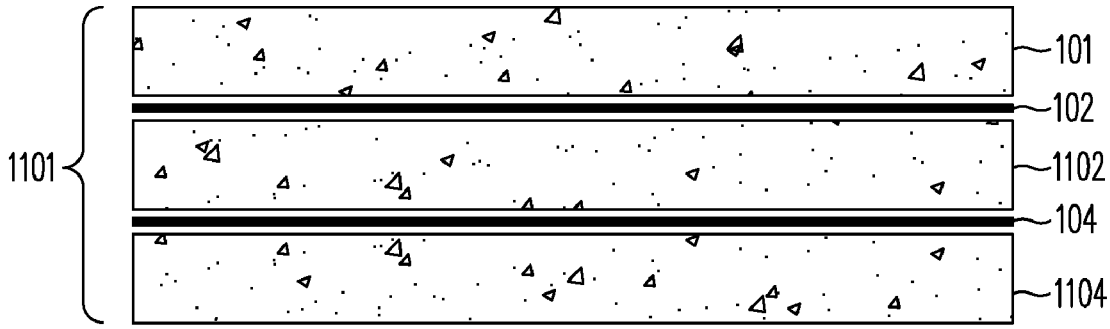

For FIG. 11, an alternative embodiment, laminated structure 1100 is disclosed. As will be appreciated by our reference thereto certain of the elements of laminated structure 1100 are common to those used in laminated structure 100 and 1000, and accordingly, have common reference characters. In laminated structure 1100, a layer of cement board 1102 is applied to the lower side of FE QuietGlue® adhesive layer 102 to provide the structure 1100. In constructing laminated structure 1100, the FE QuietGlue® adhesive layer 102 may be applied first to the lower surface of gypsum board 101, or alternatively to the upper surface of cement board 1102, after which the combination is heated for drying and pressed as described above in the earlier embodiments. FIG. 11A discloses an alternative embodiment which provides an improved structure over that described in FIG. 11. In FIG. 11A common reference characters are used for common structure illustrated in the prior figure or prior figures. As will be appreciated by reference to FIG. 11A, a second glue layer 104 is interposed between cement board 1102 and a third layer of material 1104. Material 1104 may take various forms, for example, it may be one of gypsum board, cement board, metal, wood or calcium silicate board. The composition and thickness of the components of layer 1104 may be the same as the commonly above described layers referred to with regard to FIG. 10.

Figure 12:
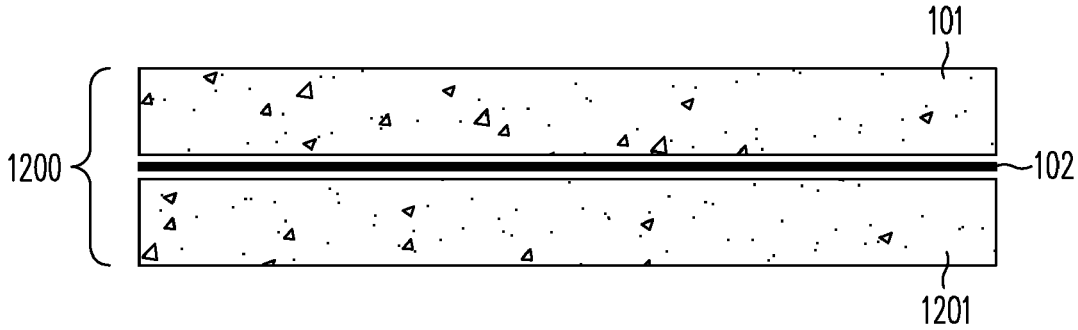
Figure 12A:
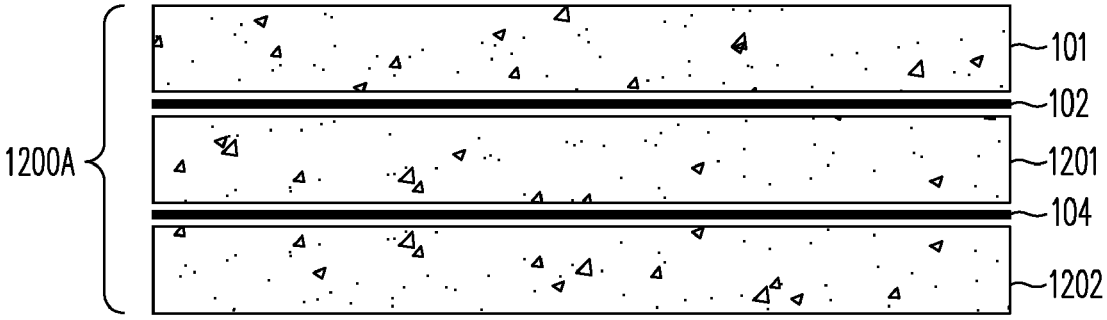

Referring to FIG. 12, laminated structure 1200 is illustrated, with the reference characters utilized in common with certain prior figures and having the characteristics as described with regard to those figures. In laminated structure 1200, a second layer material 1201 which is calcium silicate board is placed beneath glue there 102 and the combination is pressed together and heated for the times and techniques as noted above. To add additional sound protection and additional fire protection, a new laminated structure 1200A is constructed as shown in FIG. 12A. In FIG. 12A the common reference characters indicate the same materials as in the prior figures and in addition laminated structure 1200A includes a third layer of material 1202 which is placed beneath glue layer 104. Suitable materials for layer 1202 include gypsum board, cement based board, metal, wood, magnesium oxide-based board and calcium silicate board. The thicknesses and characteristics of these materials are the same as those described above with regard to previous figures. This laminated structure 1200A advantageously provides additional fire protection and a noise isolation.

Figure 13:
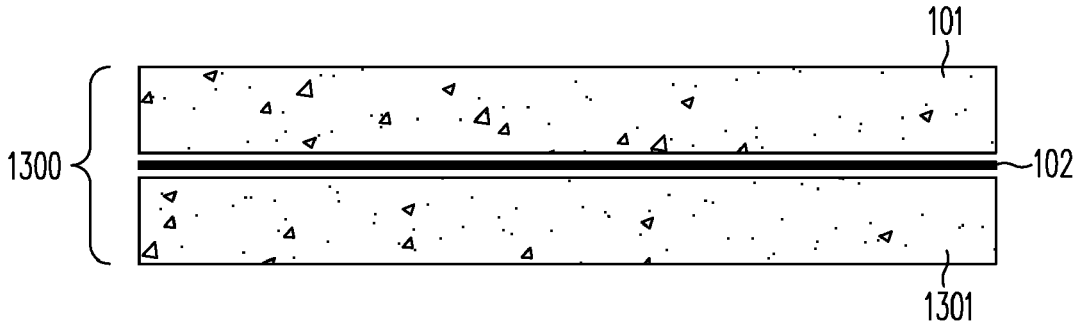
Figure 13A:
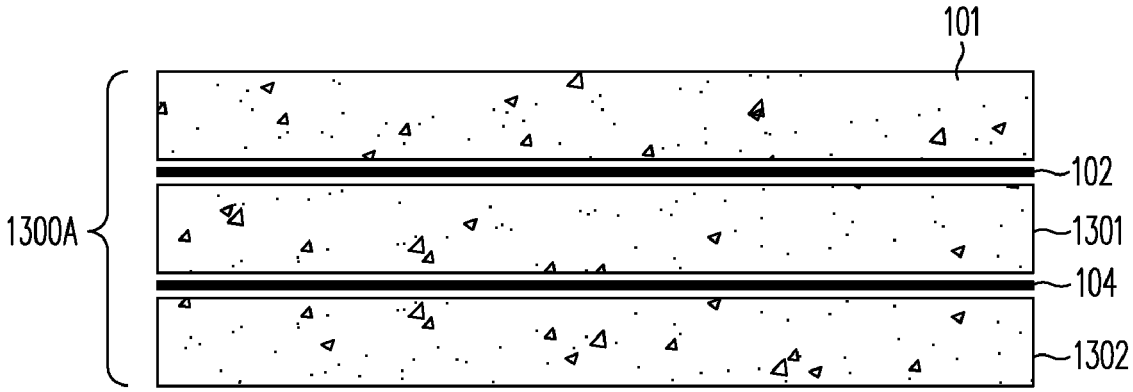

According to FIG. 13, yet another embodiment of the present invention is disclosed. In this embodiment, laminated structure 1300 is disclosed and includes certain common layers from prior embodiments and more particularly gypsum layer 101 and glue layer 102. In this embodiment, layer 301 immediately beneath glue layer 102 is a layer of magnesium oxide-based board. This layer may have composition and thickness of magnesium oxide layers described in preceding figures and embodiments. FIG. 13A discloses a modification of the structure of FIG. 13, more particularly, laminated structure 1300A includes a lower, outer layer 1302 which may be made of various materials. As will be appreciated by reference to FIG. 13A a second glue layer 104 is interposed between layers 1301 and 1302 and in the final construction the layers are compressed and heated in a manner described above with regard to earlier embodiments. Lower layer 1302 may be any one of a layer of gypsum board, cement-based board, metal, wood, magnesium oxide-based board or calcium silicate board. The specific composition and thicknesses of these layers are the same as corresponding composition layers referenced in regard to earlier figures and embodiments.

Figure 14:
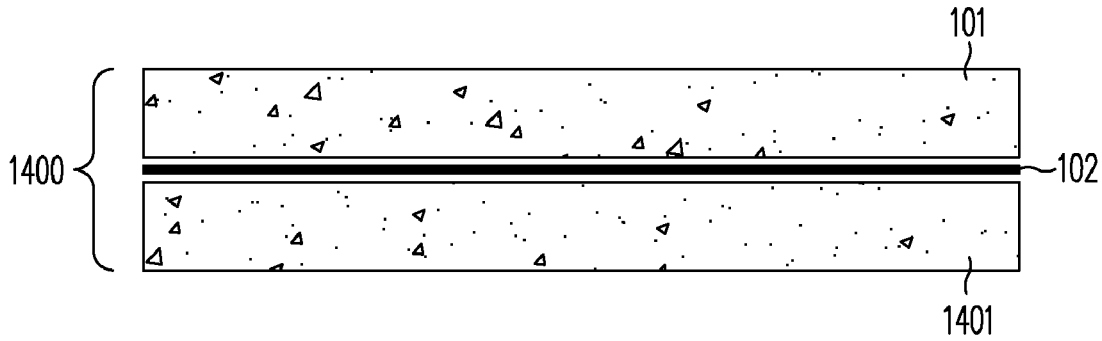
Figure 14A:
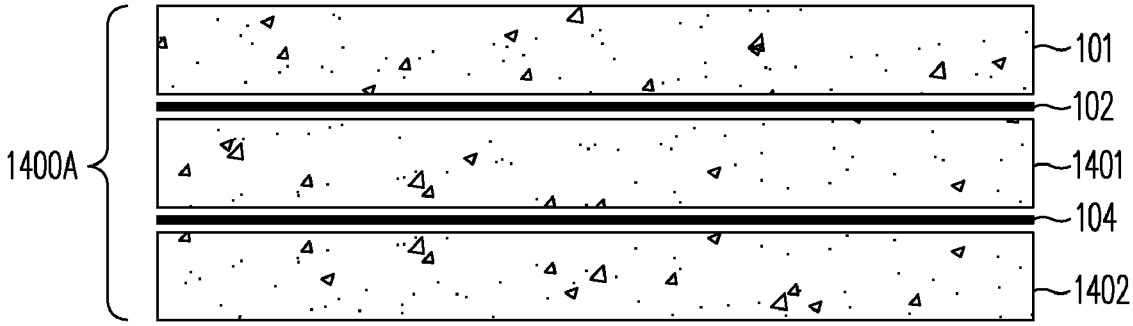

A further embodiment of the present invention is illustrated in FIG. 14 where a laminated structure 1400 is illustrated. Common structures in this figure have common reference characters with those in prior figures. In addition to gypsum board 101 and fire-resistive glue 102, a layer 1401 of phosphate based cement board is utilized as the lower, outer layer of laminated structure 1400. The thickness of phosphate based cement board 1401 is between ¼ and ½ inch. Such board is commonly available and may be referred to by the following terms: EcoRock, available from Serious Material of Sunnyvale, Calif. FIG. 14A discloses yet another embodiment. As will be appreciated by reference to the figures, many of the common layers is in laminated structure 1400. In addition, laminated structure 1400A includes a second glue layer 104 and a lower layer 1402 which may be any one of a number of materials. Suitable materials for layer 1402 include, for example, gypsum board, cement based board, metal, wood, magnesium oxide-based board or calcium silicate board. The characteristics and dimensions of structures for layer 1402 are as described above with respect to other figures and embodiments.

Figure 15:
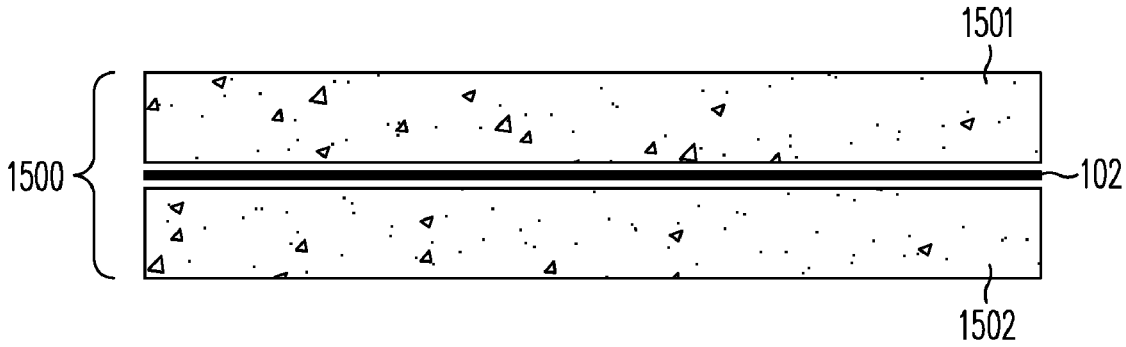
Figure 15A:
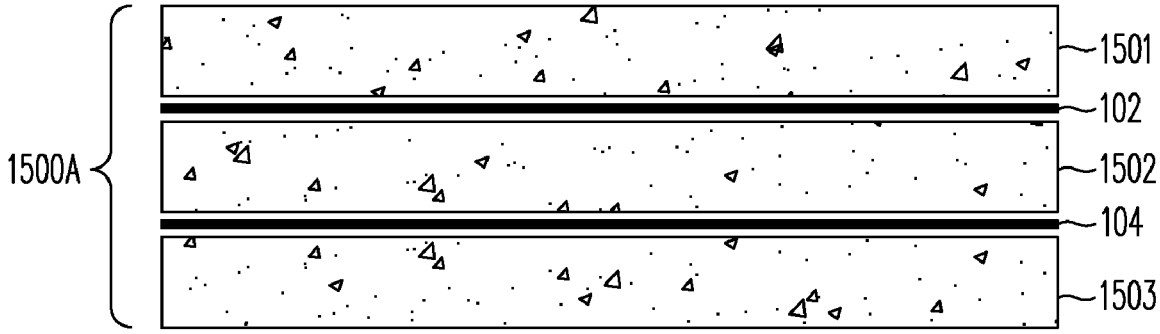

Referring to FIG. 15, a further embodiment of the present invention is disclosed, more particularly laminated structure 1500. In this embodiment, layers 1502 and 1501 are cement board and the glue layer 102 is comparable to the prior glue layers having like reference character. All of these layers of cement board have the same characteristics and thicknesses as described above with regard to earlier embodiments and figures in which cement board was used. A variation and further embodiment of the present invention is disclosed in FIG. 15A showing laminated structure 1500A. As will be appreciated by reference to FIGS. 15 and 15A, certain of the layers are common and accordingly have common reference characteristics. In the embodiment shown in FIG. 15A, a lower layer 1503 is provided. This layer is secured in the combination of layers using glue layer 104 which is intermediate layers 1502 and 1503. Composition of layer 1503 may take various forms, and more particularly, layer 1503 may be gypsum board, cement board, metal, wood, magnesium oxide-based board wood or calcium silicate board. The structure and dimension of these layers are the same as that disclosed above for like layers.

Figure 16:
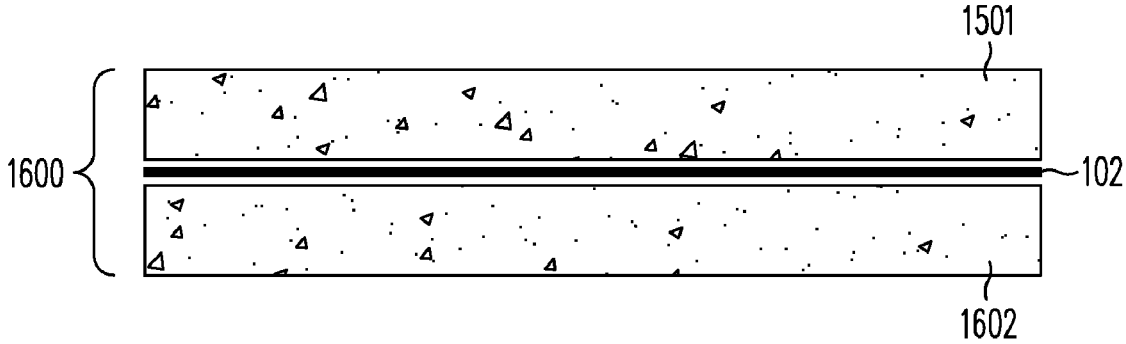
Figure 16A:
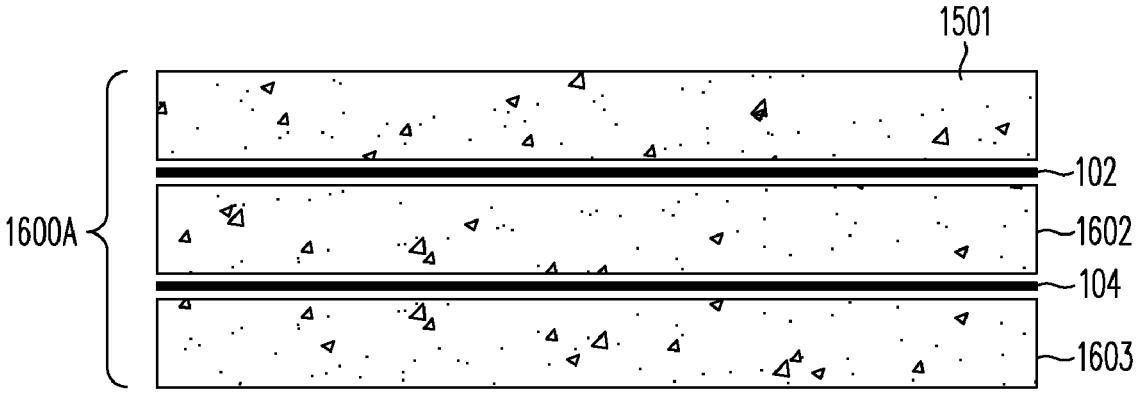

FIG. 16 illustrates a further embodiment of the present invention, more particularly showing laminated structure 1600. In this structure, the upper layer 1501 is a cement board, glue 102 is as described in previous figures, and layer 1602 is a calcium silicate board. The composition and thicknesses are the same as described above for like composition boards. FIG. 16A shows yet another embodiment, more particularly laminated structure 1600A. Certain of the structures are the same as those in laminated structure 1600 and accordingly have the same reference character. In addition to the structures shown in laminated structure 1600, a second glue layer 104 is provided and is situated between layer 1602 and layer 1603, the lower and outer layer in this embodiment. Layer 1603 may take various forms and more particularly, it may be gypsum board, cement board, metal, wood, magnesium oxide-based board or calcium silicate board. The thicknesses of these layers of material of which are common to the previous embodiments are the same as those described above in those preceding embodiments.

Figure 17:
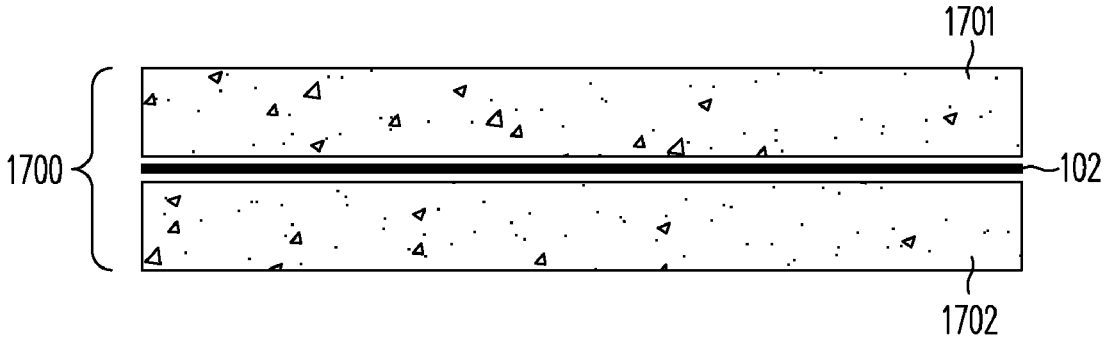
Figure 17A:
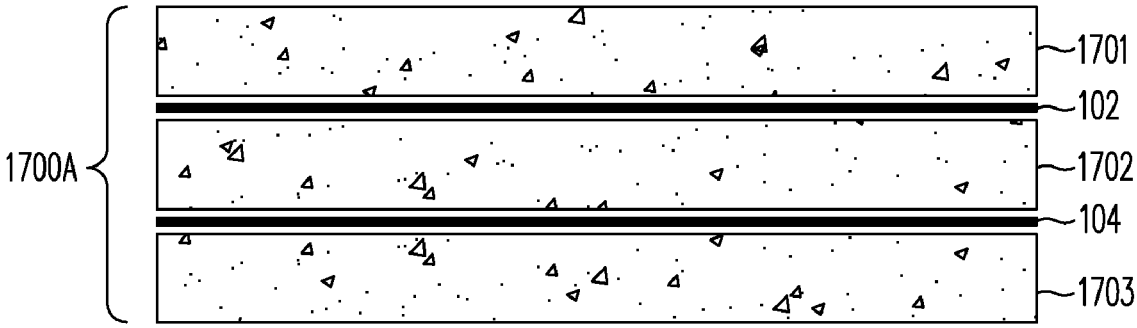

FIGS. 17 and 17A illustrate two additional embodiments of the present invention. In laminated structure 1700, layer 1701 and layer 1702 are both calcium silicate boards having the dimensions consistent with the calcium silicate boards described in previous embodiments. In laminated structure 1700, glue layer 102 is interposed between outer layers 1701 and 1702 and the combination is pressed and heated to make laminated structure 1700 in a fashion similar to that described above in previous embodiments. Turning to FIG. 17A, laminated structure 1700A includes in common with the prior laminated structure 1700, layers 1701, 102 and 1702. In addition to these common layers, a second layer of glue 104 is interposed between layers 1702 and material 1703. The material for layer 1703 may be any one of gypsum board, cement board, metal, wood, magnesium oxide-based board or calcium silicate. The selection is up to the discretion of the designer. The thicknesses of these materials usable for layer 1703 is the same as that described for like composition layers in the previous embodiments.

Figure 18:
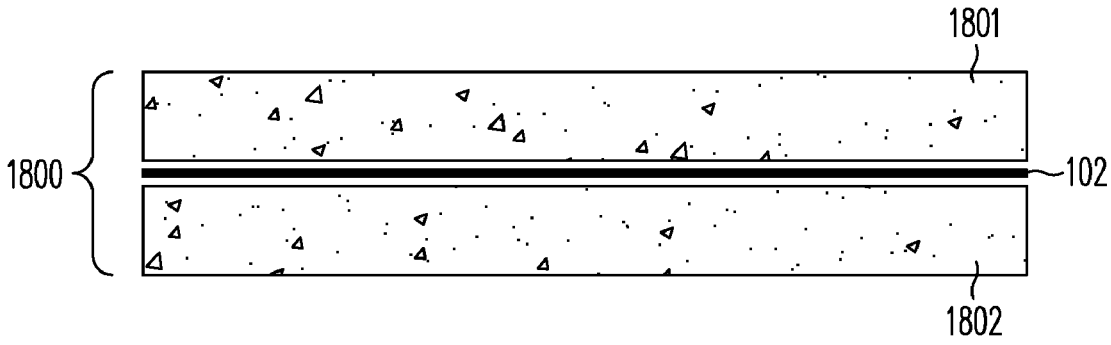
Figure 18A:
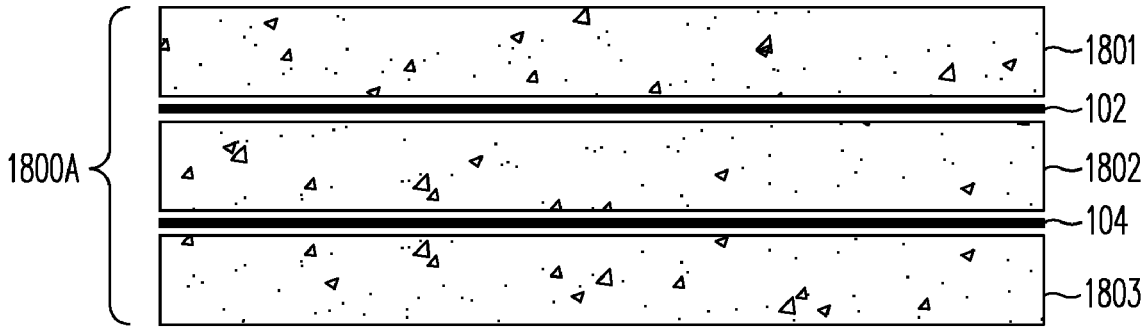

FIG. 18 illustrates yet another embodiment of the present invention, disclosing laminated structure 1800 which includes outer layers 1801 and 1802, both of magnesium oxide-based board, with glue layer 102 interposed between the inner surfaces of layers 1801 and 1802. FIG. 18A discloses yet another embodiment of the present invention, more particularly laminated structure 1800A. Laminated structure 1800A shares a number of common elements with laminated structure 1800 and these accordingly have common reference characters associated with them. In laminated structure 1800A, a second glue layer 104 is situated beneath layer 1802 and an outer layer 1803, which may be any one of the materials such as gypsum board, cement board, metal, wood, magnesium, oxide-based board or calcium silicate board. The thicknesses of the materials for layer 1803 are the same as that described above before correspondingly composed layers of material.

Figure 19:
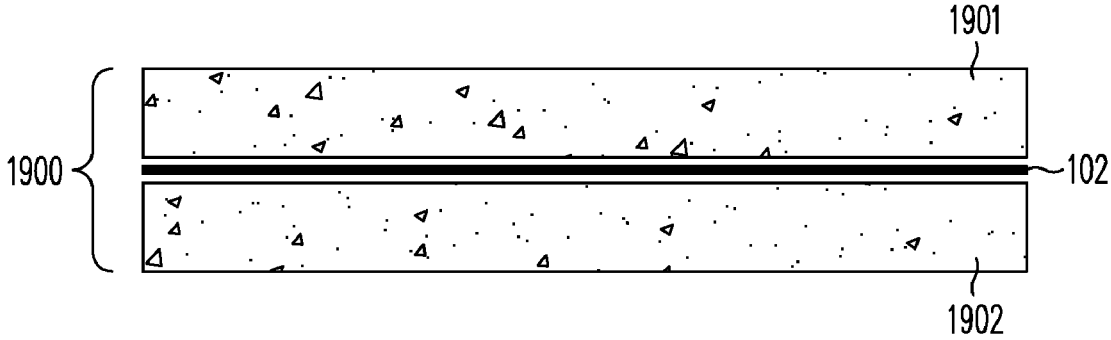
Figure 19A:
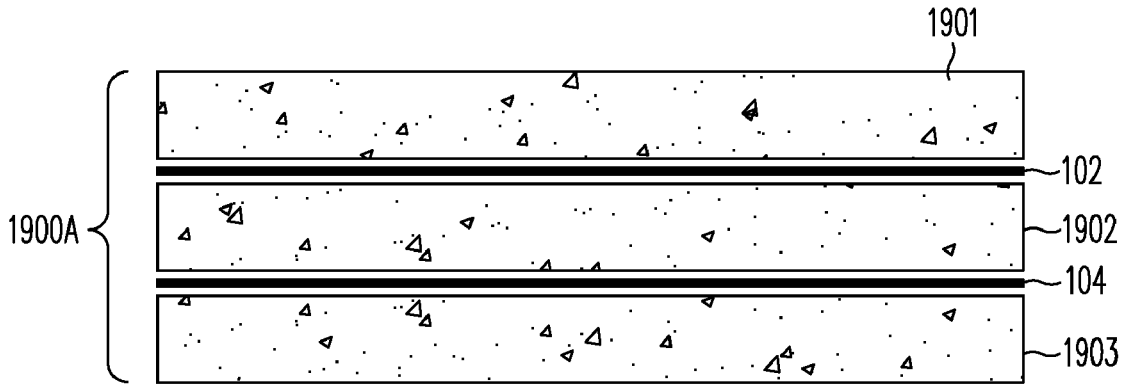

FIG. 19 illustrates yet another embodiment of a fire-enhanced/fire-resistant laminated panel 1900. In laminated panel 1900, layers 1901 and 1902 are both phosphate-based cement board and have glue layer 102 interposed between the inner surfaces of layers 1901 and 1902. FIG. 19A illustrates a further embodiment, with some of the common layers to those illustrated in laminated structure 1900. Common layers of course include common reference characters. In laminated structure 1900A, a second layer of glue 104 is interposed between the lower surface of layer 1902 and layer 1903. The materials suitable for layer 1903 include gypsum board, cement board, metal, wood, magnesium, oxide-based board and the calcium silicate board.

Figure 20:
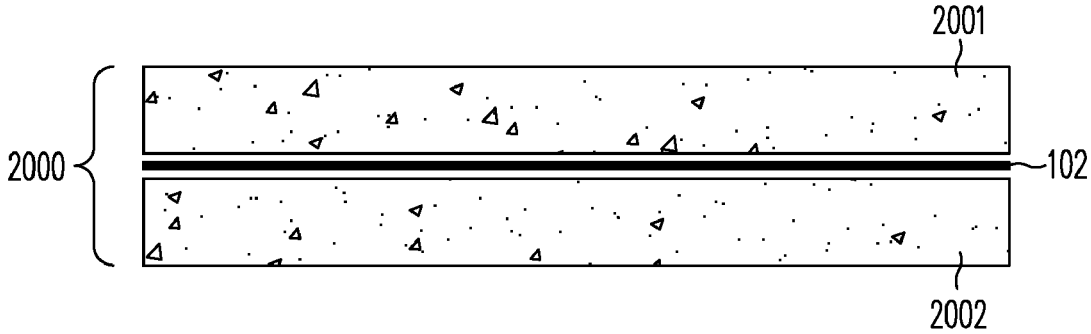
Figure 20A:
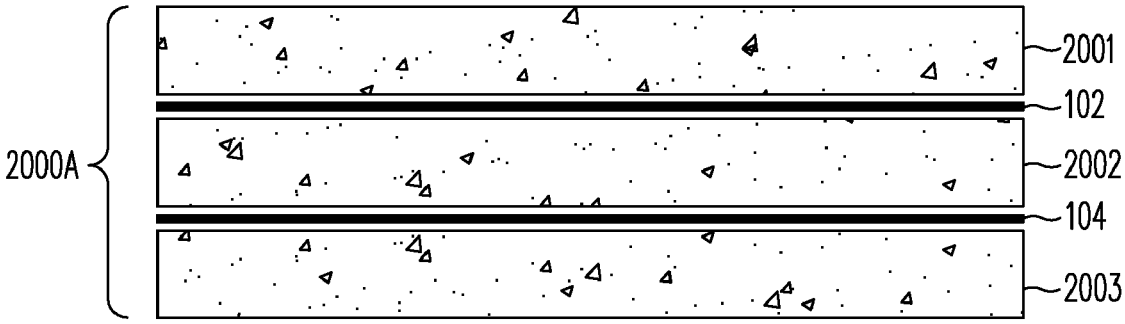

A further embodiment of the present invention is illustrated in FIG. 20, which shows laminated structure 2000 having layers 2001 and 2002 constructed, respectively, of magnesium oxide-based board and calcium silicate board. Glue layer 102 is included intermediate the layers 2001 and 2002 and the construction techniques are the same as those described above as regarding earlier embodiments. In FIG. 20A laminated structure 2000A is disclosed. As will be appreciated by reference to FIG. 20A two glue layers 102 and 104 and solid layers 2001, 2002 and 2003 are included. Layers 2001 and 2002 are the same as noted above in respect to laminated structure 2000. The lower layer 2003 may take various compositions and dimensions in terms of thickness, more particularly, layer 2003 may be any one of gypsum board, cement board, metal, wood, magnesium oxide-based wood or calcium silicate board. The thicknesses of these materials are the same as the like materials described in prior embodiments.

Figure 21:
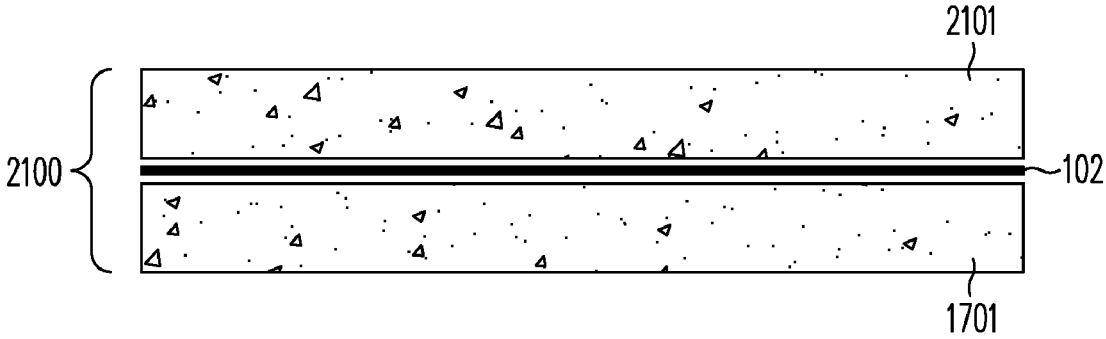
Figure 21A:
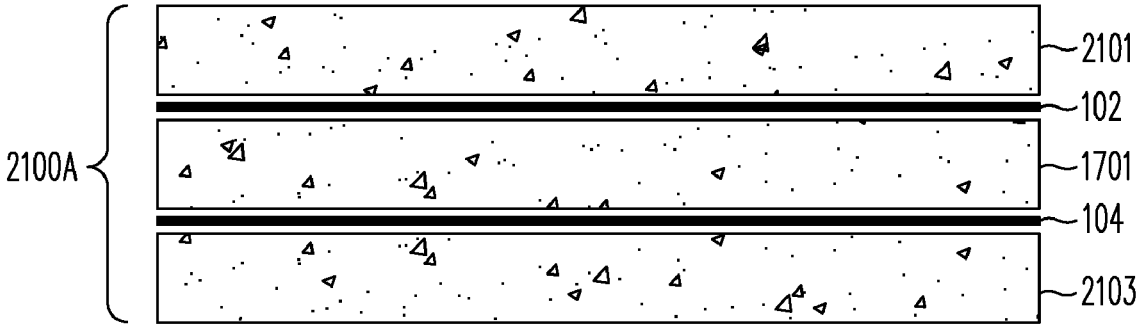

Turning to FIG. 21, another embodiment of a fire resistant, sound attenuating structure is disclosed. Laminated structure 2100 includes first layer 2101 which is a phosphate based board, glue layer 102, and calcium silicate board 1701. The thicknesses of these two layers are the same as that disclosed above for like composition layers. FIG. 21A discloses yet another embodiment, showing laminated structure 2100A. Certain of the layers are common with laminated structure 2100 shown in FIG. 21 and accordingly carry a common reference character. In laminated structure 2100A, a second glue layer 104 is interposed between layer 2103 and layer 1701. Layer 2103 may be constructed of various materials, including gypsum board, cement board, metal, wood, magnesium oxide-based board and calcium silicate board.

Figure 22:
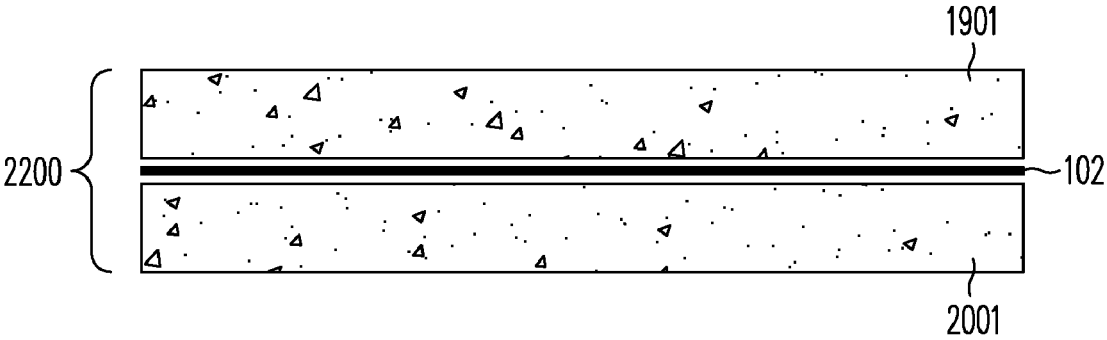
Figure 22A:
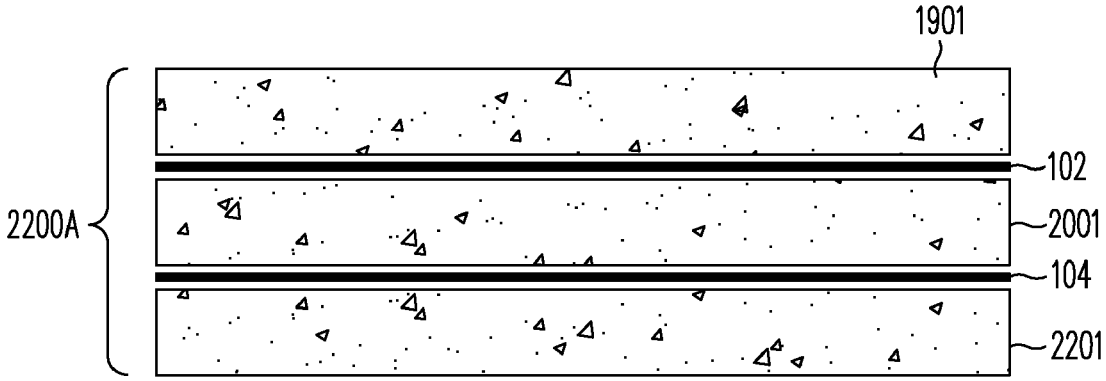

A further embodiment of the present invention is illustrated in FIG. 22, wherein laminated structure 2200 is disclosed. Laminated structure 2200 includes phosphate board layer 1901 and magnesium oxide-based board 2001 which are positioned on opposite sides of glue layer 102. The thicknesses and composition of these layers are the same as described above with respect to the same composition layers. FIG. 22A discloses yet another embodiment, showing laminated structure 2200A. As will be appreciated by comparison of FIG. 22 and FIG. 22A, certain of the layers are common and accordingly have common reference characters. In laminated structure 2200A, an additional layer 2201 is provided as an outer layer. This Layer 2201 may have a composition of various materials, such as gypsum board, cement board, wood, metal, magnesium oxide-based board or calcium silicate board. The thicknesses of these bottom layers are the same as those described above with respect to similarly composition layers.

Figure 23:
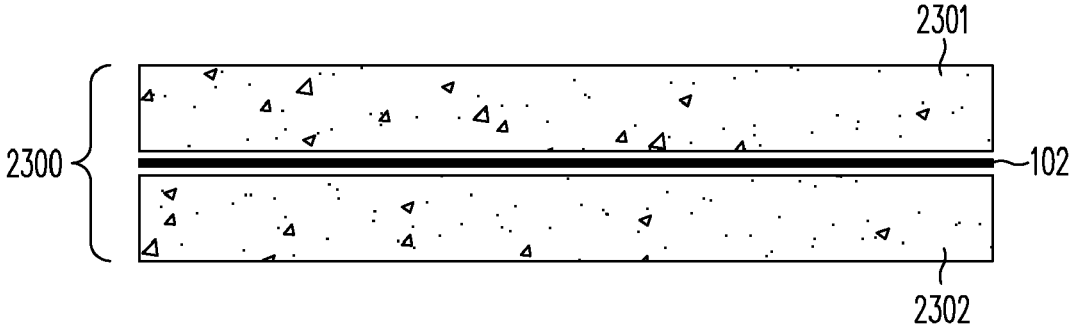
Figure 23A:
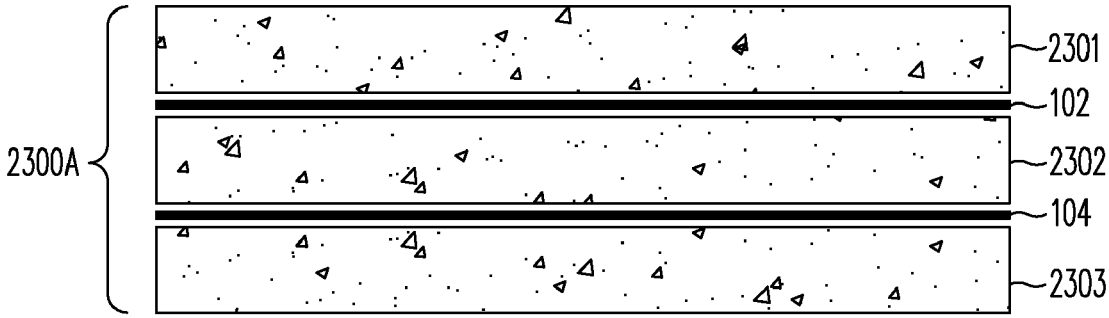

FIG. 23 discloses a further embodiment of the present invention, illustrating the laminated structure 2300. In laminated structure 2300, first and second layers 2301 and 2302 are layers of a cellulose-based material such as wood, which may be for example solid wood or of a plywood structure, or alternatively medium density fiber board, or particle board. FE QuietGlue® adhesive layer 102 is positioned between the inner surfaces of layers 2301, 2302 and the structure is constructed in a manner described above with regard to earlier embodiments. FIG. 23A illustrates a further embodiment which utilizes certain of the structures in laminated panel 2300 illustrated in FIG. 23. In FIG. 23A, an additional layer of FE QuietGlue® viscoelastic adhesive 104 is placed on the lower surface of layer 2302, and another layer of material 2303 is then attached, with a combination being heated and compressed to ultimately produce laminated structure 2300A. Various materials may be used in layer 2303, such as, for example, gypsum board, cement board, metal, wood, magnesium oxide-based board or a calcium silicate board. The addition of the second layer of glue 104 along with a third layer of material 2303 increases the fire resistance capability as well as improving the STC rating of laminated structure 2300A. The thicknesses of each of these materials for layer 2303 and other characteristics are consistent with the above-described layers having the same composition.

Figure 24:
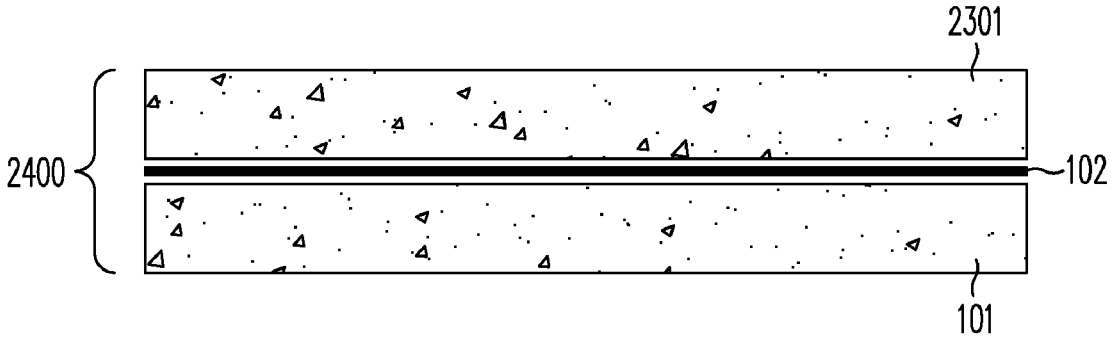
Figure 24A:
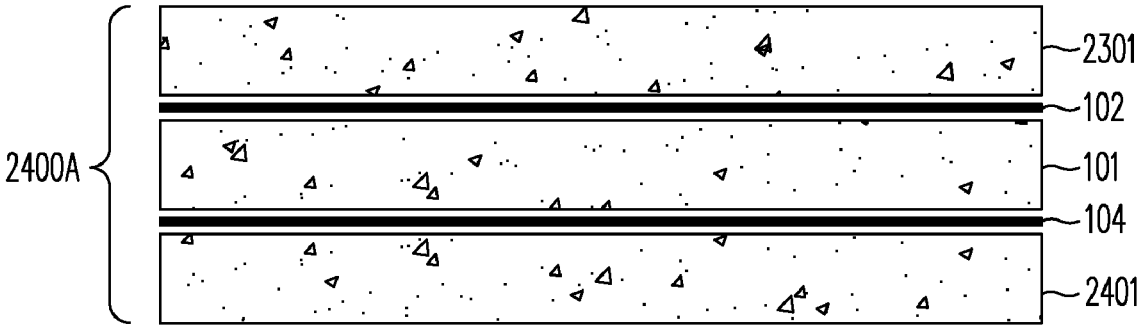

FIG. 24 discloses yet another embodiment of the present invention. Laminated structure 2400 is made utilizing layer 2301 of a cellulose-based material, such as wood, along with layer 102 of fire enhanced viscoelastic glue which is interposed between layer 2301 and gypsum board layer 101. In an alternative embodiment, additional fire resistance and increased STC is produced using laminated structure 2400A illustrated in FIG. 24A. Common structures in this figure with those in FIG. 24 contain like reference characters. In addition to the layers in laminated structure 2400, in laminated structure 2400A a third layer of material 2401 is provided, with the combination being secured using second glue layer 104. Suitable materials for layer 2401 include magnesium oxide-based board, gypsum board, cement based board, metal, a cellulose-based material of the type described above for layer 2301, or calcium silicate board.

Figure 25:
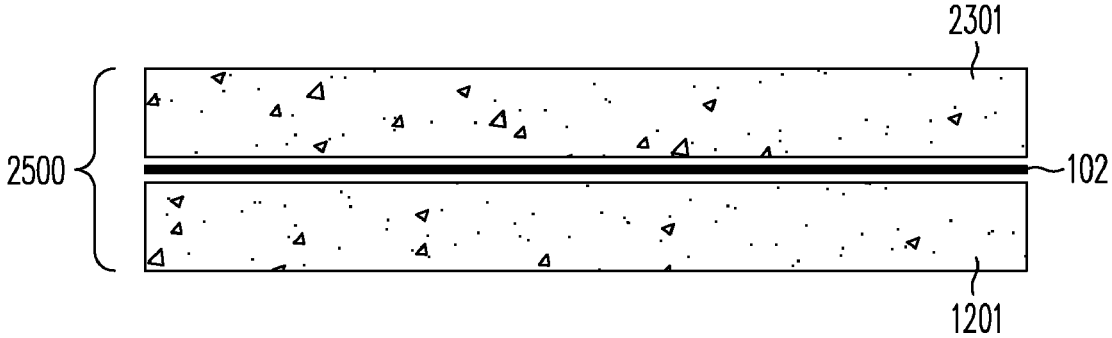
Figure 25A:
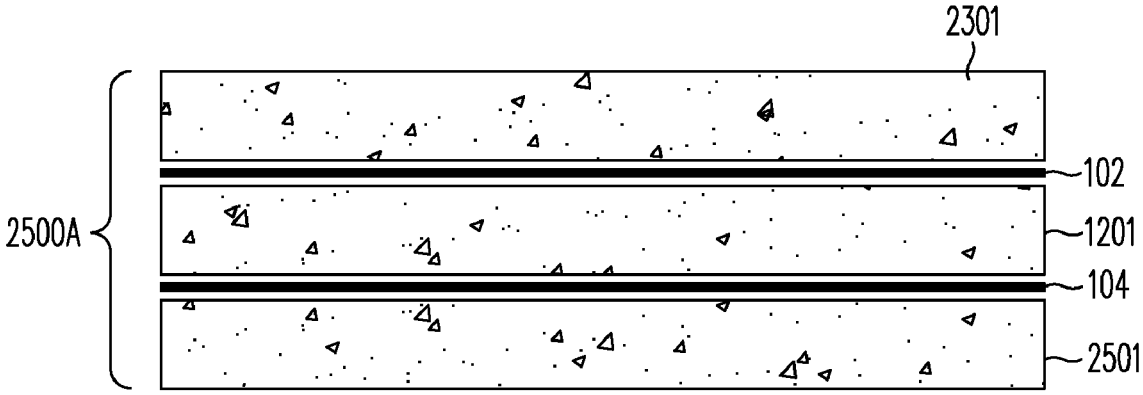

A further embodiment of the present invention is illustrated in FIG. 25 wherein laminated structure 2500 is shown. This structure includes the first layer 2301 of a cellulose-based material, a second layer 1201 of calcium silicate board and a glue layer 102 interposed between the first and second layers 2301 and 1201, respectively. As will be appreciated by reference to FIG. 25 and preceding references, commonly used reference character numbers are applied in this figure which correspond to the reference characters used in prior figures. The thicknesses and composition of layers 2301 and 1201 are as set forth above. To provide additional soundproofing and fire resistance, an additional layer of material, indicated by reference character 2501 is added to provide laminated structure 2500A as illustrated in FIG. 25A. A layer of fire-resistive, viscoelastic glue 104 is interposed between layers 2501 and 1201. Layer 2501 may be any one of a number of materials such as, for example, gypsum board, cement board, metal, wood, magnesium oxide-board and a calcium silicate board. The thicknesses of glue layer 104 and its application as well as the physical characteristics of the materials of layer 2501 are the same as those set forth above in like denominated layers.

Figure 26:
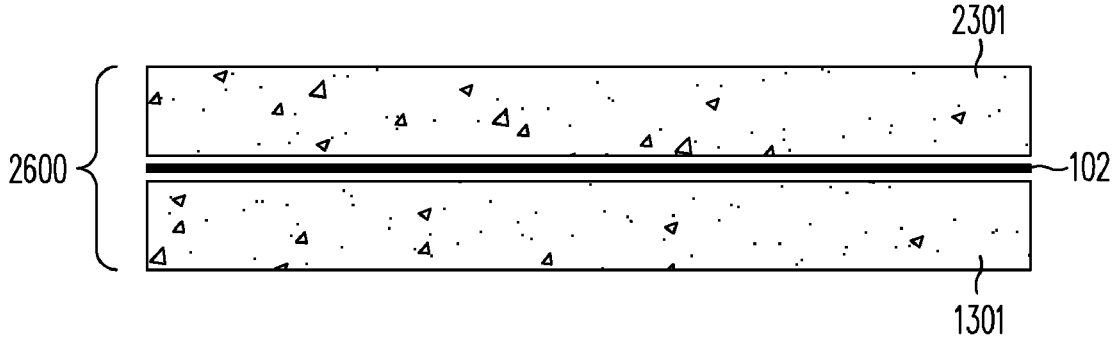
Figure 26A:
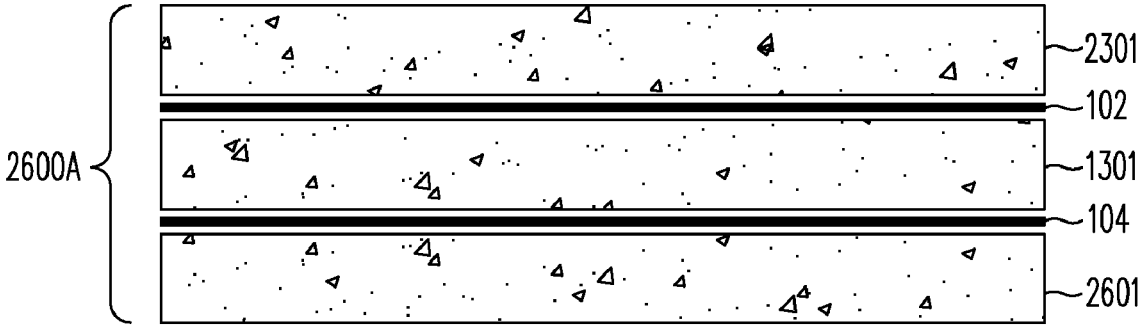

A further embodiment of the present invention is illustrated in FIG. 26 which shows laminated structure 2600. In this structure, the upper layer 2301 is a cellulose-based material, the bottom layer 1301 is magnesium oxide-based board, and interposed between the two is a layer 102 of fire-resistive viscoelastic glue. The construction and dimensional specifics of the first and second layers 2301 and 1301, respectively, are the same as those given above for like numbered elements. To provide additional fire resistance and improvement in STC characteristics, a modification of laminated structure of FIG. 26 is illustrated in FIG. 26A wherein laminated structure 2600A as illustrated. Like elements in FIG. 26A to those in FIG. 26 carry the same reference character. In the embodiment of FIG. 26A, an additional layer of fire-resistive, viscoelastic glue 104 is provided, along with a bottom layer 2601. The composition of layer 2601 may take various forms, depending on the usage of laminated structure 2600A. Examples of suitable materials for use in layer 2601 include gypsum, cement board, metal, a cellulose-based material, magnesium oxide-based board and calcium silicate board. The specific composition and thicknesses of these layers suitable for layer 2601 are the same as those indicated above for like composition layers.

Figure 27:
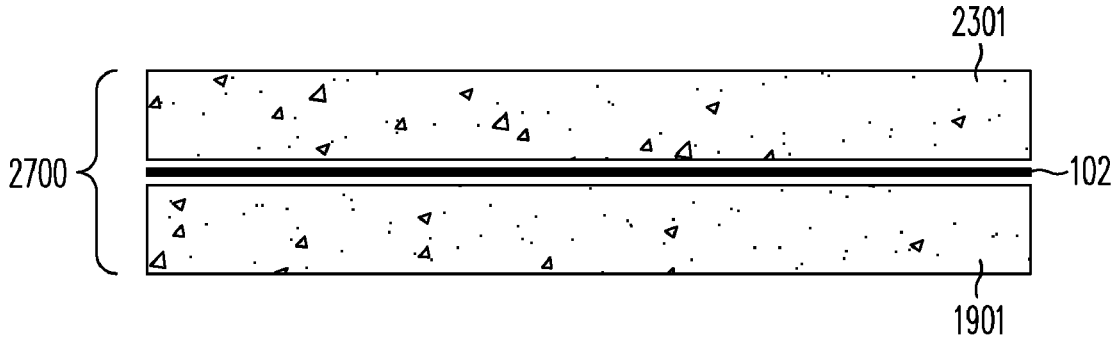
Figure 27A:
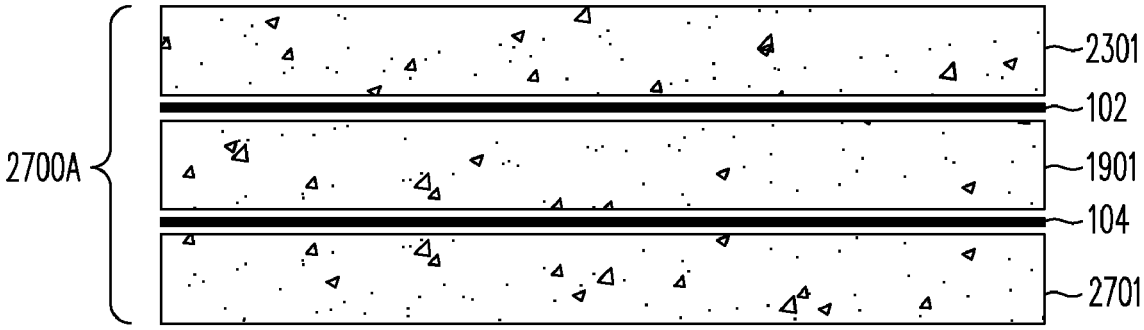

Yet another embodiment of the present invention is disclosed in FIG. 27 where laminated structure 2700 is shown. Laminated structure 2700 includes a first layer 2301 of a cellulose-based material, and a phosphate based cement based cement board layer 1901. These layers being disposed on opposite sides of a layer of fire-resistive, viscoelastic glue indicated by reference character 102. The fire-resistive, viscoelastic glue 102 may be applied to either surface of one of the layers and layered combination dried, heated and compressed in the manner described above for previous embodiments. FIG. 27A shows a variation of the preceding embodiment, with laminated structure 2700A being shown in cross section. The common elements from the preceding figure and other figures have common reference characters and the characteristics thereof are the same as described previously. In laminated structure 2700A a bottom layer 2701 is added in addition to layer 104 of fire-resistive, viscoelastic glue. The composition of layer 2701 may be of various kinds of materials which include, for example, gypsum board, cement board, metal, a cellulose-based material, magnesium oxide-based board or calcium silicate board. Further soundproofing and fire intrusion resistance is provided with the added layer of glue 104 and the bottom layer 2701. The composition and thicknesses of the above-mentioned materials suitable for layer 2701 are consistent with those for some other type layers in preceding embodiments.

Figure 28:
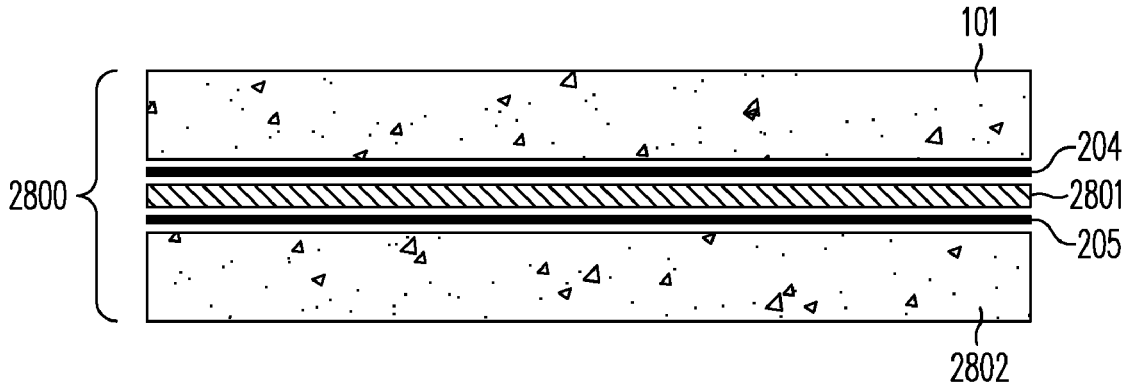

Yet another embodiment of the present invention is illustrated in FIG. 28 which shows laminated panel 2800. Panel 2800 includes outer layers of gypsum board indicated by reference characters 101 and 2802. The interior of these two outer layers is a layer of metal denoted by reference character 2801, with fire-resistive, viscoelastic glue layers 204 and 205 positioned on opposite sides of metal layer 2801. Metal layer 2801 may be, for example, 30 gauge galvanized steel or other steel of 16 to 48 gauge thickness. Alternative metal layers may be utilized. Structures in laminated panel 2801 which are common with those structures in prior figures use the same reference character for convenience of explanation. The construction of laminated panel 2800 follows that set forth above with respect to the application of the glue, the drying processes and the pressures used to provide a rigid structure.

Figure 28A:
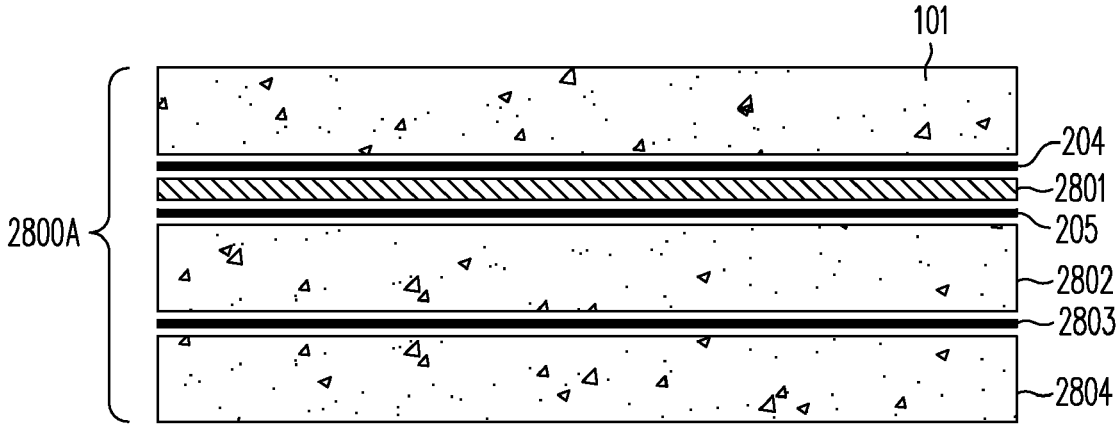

A further embodiment of the present invention is illustrated in FIG. 28A which shows laminated structure 2800A. As will be appreciated by reference to FIGS. 28 and 28A concurrently, certain layers of materials are used in both embodiments. In laminated structure 2800A, an additional layer of fire-resistive, viscoelastic glue 2803 is utilized along with a fourth layer of material indicated by reference character 2804. Fire-resistive, viscoelastic glue layer 2803 may have a composition as set forth above in TABLE 1. Layer 2804 may be any of a number of materials, for example, gypsum board, cement board, metal, a cellulose-based material, magnesium oxide-based board or calcium silicate board. In this embodiment, glue layer 2803 may be applied either to a surface of gypsum board 2802 and thereafter layer 2804 added, or alternatively the glue layer 2803 may be placed on layer 2804 and then the combination pressed into place with the other layers of material for a final processing.

Figure 29:
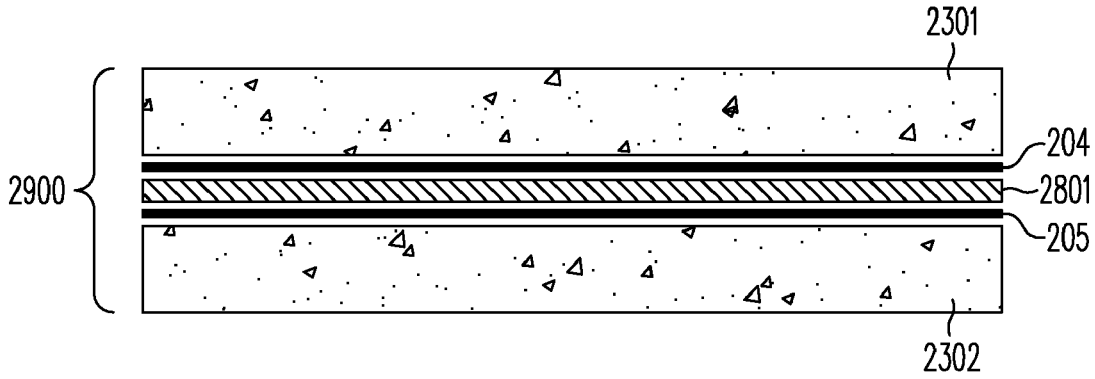
Figure 29A:
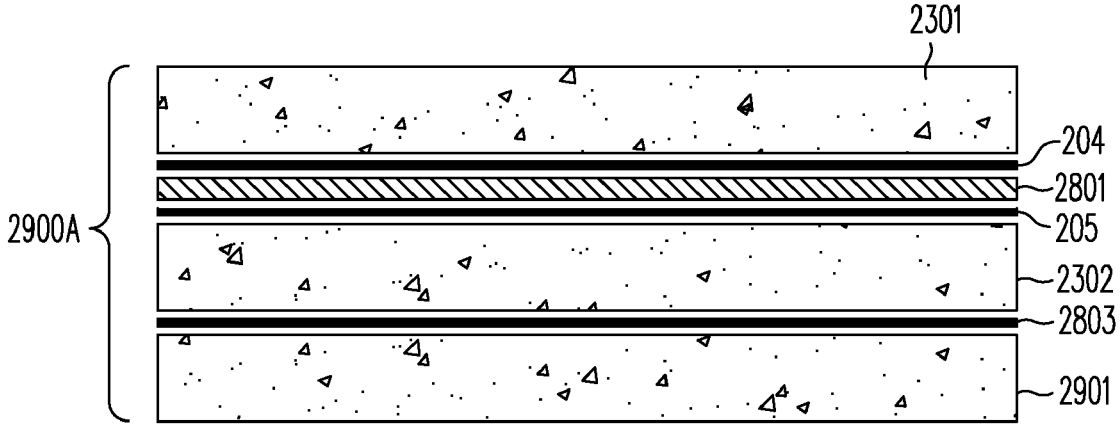

Another embodiment of the present invention is disclosed FIG. 29. In this embodiment, laminated panel 2900 is made up of outer layers 2301 and 2302 which are a cellulose-based materials. More particularly, layers 2301 and 2302 may be, for example, plywood of a thickness between 14 and ⅝ inch, or another performance rated wood product such as oriented strand board (OSB) or medium density fiberboard (MDF). Interposed between the inner surfaces of layers 2301 and 2302 is a metal constraining layer 2801 which may be, for example, 30 gauge sheet metal, along with fire-resistive, viscoelastic glue layers 204 and 205 interposed between constraining layer 2801 and the associated outer layers 2301 and 2302. With the constraining layer 2801 and the two layers of fire-resistive, viscoelastic glue, improved sound reduction as well as fire resistance is provided. Yet another embodiment of the present invention is illustrated in FIG. 29A. Comparing FIGS. 29 and 29A, it will be appreciated that there are a number of common structures. In laminated structure 2900A a third layer of fire-resistive viscoelastic glue indicated by reference character 2803 is added. An additional layer of material 2901, as well as the additional layer of fire-resistive, viscoelastic glue 2803 provides for the improved STC value for the structure in addition to providing further fire intrusion protection. Layer 2901 may be any one of a number of materials, including, but not limited to, gypsum board, cement board, metal, a cellulose-based material, magnesium oxide board or calcium silicate board. The thicknesses of these materials and the composition is the same as those for the correspondingly type material in the previous examples.

The dimensions given for each material in the laminated structures of the present invention can be varied in light of consideration such as cost, overall thickness, weight and STC and fire intrusion resistance. The above-described embodiments and their dimensions are illustrative and not limiting. In addition, further other embodiments of this invention will be obvious in view of the above description.

Accordingly, the laminated structure of this invention provides a significant improvement in the sound transmission class number associated with the structures and thus reduces significantly the sound transmitted from one room to adjacent rooms while simultaneously providing for significant improvement of the fire resistance of these structures.

The dimensions given for each material in the laminated structures of this invention can be varied as desired to control cost, overall thickness, weight, anticipated fire resistance, and STC results. The described embodiments and their dimensions are illustrative only and not limiting.

Other embodiments of this invention will be obvious in view of the above description.

What is claimed is:

1. A laminated sound-attenuating structure comprising:

a first layer of gypsum-board having first and second surfaces;

a first layer of fire-resistive, viscoelastic glue on the first surface; and a second layer of gypsum-board on the first layer of fire-resistive, viscoelastic glue, wherein:

said fire-resistive, viscoelastic glue contains intumescent compounds such that the fire resistance of the structure is greater by at least about seven minutes than the fire resistance of the structure having a viscoelastic glue without the intumescent compounds; the viscoelastic glue contains between 30% and 70% of acrylate polymer by weight; and further wherein:

said fire-resistive, viscoelastic glue has a glass transition temperature below room temperature.

2. The laminated sound-attenuating structure of claim 1, further comprising:

a second layer of fire-resistive, viscoelastic glue on a side of one of the first and second layer of gypsum board opposite the first layer of fire-resistive, viscoelastic glue; and a third layer of material selected from the group consisting of gypsum board, cement-based board, metal, wood, magnesium oxide-based board, and calcium silicate board on the second layer of fire-resistive, viscoelastic glue.

3. A laminated, sound-attenuating structure comprising:

a layer of gypsum-board having first and second surfaces;

a first layer of fire-resistive, viscoelastic glue on one of the first and second surfaces; and a layer of a cement-based board on an exposed surface of the fire-resistive, viscoelastic glue, wherein:

said fire-resistive, viscoelastic glue contains intumescent compounds, between 30% and 70% of acrylate polymer by weight, rosin ester; and further wherein said fire-resistive, viscoelastic glue has a glass transition temperature below room temperature.

4. The laminated, sound-attenuating structure of claim 3, further comprising a second layer of fire-resistive, viscoelastic glue on one surface of the cement-based board, and a third layer of material selected from the group consisting of gypsum board, cement-based board, metal, wood, magnesium oxide-based board, and calcium silicate board on the second layer of fire-resistive, viscoelastic glue.

5. A laminated, sound-attenuating structure comprising:

a layer of gypsum-board having first and second surfaces;

a first layer of fire-resistive, viscoelastic glue on one of the first and second surfaces; and a layer of calcium silicate board on the fire-resistive, viscoelastic glue, wherein:

said fire-resistive, viscoelastic glue contains intumescent compounds, between 30% and 70% of acrylate polymer by weight, rosin ester, and sodium carbonate by weight; and further wherein:

said fire-resistive, viscoelastic glue has a glass transition temperature below room temperature.

6. The laminated, sound-attenuating structure of claim 5, further comprising a second layer of fire-resistive, viscoelastic glue on one surface of the layer of calcium silicate board, and a third layer of material selected from the group consisting of gypsum board, cement-based board, metal, wood, magnesium oxide-based board, and calcium silicate board on the second layer of the fire-resistive, viscoelastic glue.

7. A laminated, sound-attenuating structure comprising:

a layer of gypsum-board having first and second surfaces;

a first layer of fire-resistive, viscoelastic glue on one of the first and second surfaces; and a layer of a magnesium oxide-based board on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

8. The laminated, sound-attenuating structure of claim 7, further comprising a second layer of fire-resistive, viscoelastic glue on one surface of the layer of the magnesium oxide-based board, and a third layer of material selected from the group consisting of gypsum board, cement-based board, metal, wood, magnesium oxide-based board, and calcium silicate board on the second layer of fire-resistive, viscoelastic glue.

9. A laminated, sound-attenuating structure comprising:

a layer of gypsum-board having first and second surfaces;

a first layer of fire-resistive, viscoelastic glue on one of the first and second surfaces; and a layer of a phosphate-based cement board on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

10. The laminated, sound-attenuating structure of claim 9, further comprising a second layer of fire-resistive, viscoelastic glue on one surface of the layer of phosphate-based cement board, and a third layer of material selected from the group consisting of gypsum board, cement-based board, metal, wood, magnesium oxide-based board, and calcium silicate board on the second layer of fire-resistive, viscoelastic glue.

11. A laminated, sound-attenuating structure comprising:

a first layer of a cement-based board having first and second surfaces;

a first layer of fire-resistive, viscoelastic glue on one of the first and second surfaces;

a second layer of a cement-based board on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

12. The laminated, sound-attenuating structure of claim 11, further comprising a second layer of fire-resistive, viscoelastic glue on one of the first and second layers of cement-based board, and a third layer of material selected from the group consisting of gypsum board, cement-based board, metal, wood, magnesium oxide-based board, and calcium silicate board on the second layer of fire-resistive, viscoelastic glue.

13. A laminated, sound-attenuating structure comprising:

a layer of cement-based board;

a first layer of fire-resistive, viscoelastic glue on a surface of the layer of cement-based board; and a layer of calcium silicate board having first and second surfaces, with the first surface on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

14. The laminated, sound-attenuating structure of claim 13, further comprising a second layer of fire-resistive, viscoelastic glue on the second surface of the layer of calcium silicate board, and a third layer of material selected from the group consisting of gypsum board, cement-based board, metal, wood, magnesium oxide based board and calcium silicate board on the second layer of fire-resistive, viscoelastic glue.

15. A laminated, sound-attenuating structure comprising:

a first layer of material having first and second surfaces;

a first layer of fire-resistive, viscoelastic glue on the first surface; and a second layer of material having first and second surfaces, the first surface positioned on the first layer of the fire-resistive, viscoelastic glue; wherein:

said first and second layers of material selected from the group consisting of calcium silicate and magnesium oxide, wherein said fire-resistive, viscoelastic glue contains intumescent compounds, between 30% and 70% of acrylate polymer by weight, rosin ester; and said fire-resistive, viscoelastic glue has a glass transition temperature below room temperature.

16. The laminated, sound-attenuating structure of claim 15, further comprising a second layer of fire-resistive, viscoelastic glue on the second surface of second layer of material, and a third layer of material selected from the group consisting of gypsum board, cement-based board, metal, wood, and calcium silicate board on the second layer of fire-resistive, viscoelastic glue.

17. A laminated, sound-attenuating structure comprising:

a first layer of phosphate-based cement board having first and second surfaces;

a first layer of fire-resistive, viscoelastic glue on the first surface; and a second layer of a phosphate-based cement board having first and second surfaces, the first surface positioned on the first layer of the fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

18. The laminated, sound-attenuating structure of claim 17, further comprising a second layer of fire-resistive, viscoelastic glue on the second surface of the second layer of phosphate-based cement board, and a third layer of material selected from the group consisting of gypsum board, cement-based board, metal, wood, and calcium silicate board on the second layer of fire-resistive, viscoelastic glue.

19. A laminated, sound-attenuating structure which comprises:

a layer of magnesium oxide-based cement board having first and second surfaces;

a first layer of fire-resistive, viscoelastic glue on one of the first and second surfaces; and a layer of calcium silicate board on the first layer of the fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

20. The laminated, sound-attenuating structure of claim 19, further comprising a second layer of fire-resistive, viscoelastic glue on one surface of the layer of calcium silicate board, and a third layer of material selected from the group consisting of gypsum board, cement-based board, metal, wood, and calcium silicate board on the second layer of fire-resistive, viscoelastic glue.

21. A laminated, sound-attenuating structure comprising:

a layer of phosphate-based cement board having first and second surfaces;

a first layer of fire-resistive, viscoelastic glue on one of the first and second surfaces; and a layer of calcium silicate board on the first layer of fire-resistive, viscoelastic glue, wherein:

said fire-resistive, viscoelastic glue containing intumescent compounds, between 30% and 70% of acrylate polymer by weight, rosin ester; and further wherein:

said fire-resistive, viscoelastic glue has a glass transition temperature below room temperature.

22. The laminated, sound-attenuating structure of claim 21, further comprising a second layer of fire-resistive, viscoelastic glue on one surface of the layer of calcium silicate board, and a third layer of material selected from the group consisting of gypsum board, cement-based board, magnesium oxide-based board, metal, wood, and calcium silicate board with said board on the second layer of fire-resistive, viscoelastic glue.

23. A laminated, sound-attenuating structure comprising:

a layer of phosphate-based cement board having first and second surfaces;

a first layer of fire-resistive, viscoelastic glue on one of the first and second surfaces; and a layer of magnesium oxide-based board on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

24. The laminated, sound-attenuating structure of claim 23, further comprising a second layer of fire-resistive, viscoelastic glue on one surface of the layer of magnesium oxide-based board, and a third layer of material selected from the group consisting of gypsum board, cement-based board, metal, wood, and calcium silicate board on the second layer of fire-resistive, viscoelastic glue.

25. A laminated, sound-attenuating structure which comprises:

a first layer of wood having first and second surfaces;

a first layer of fire-resistive, viscoelastic glue on the first surface; and a second layer of wood having first and second surfaces, the first surface positioned on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

26. The laminated, sound-attenuating structure of claim 25, further comprising a second layer of fire-resistive, viscoelastic glue on the second surface of the second layer of wood, and a third layer of material selected from the group consisting of magnesium oxide-based board, gypsum board, cement-based board, metal, wood, and calcium silicate board on the second layer of fire-resistive, viscoelastic glue.

27. A laminated, sound-attenuating structure which comprises:

a layer of wood having first and second surfaces;

a first layer of fire-resistive, viscoelastic glue on one of the first and second surfaces; and a layer of gypsum board on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

28. The laminated, sound-attenuating structure of claim 27, further comprising a second layer of fire-resistive, viscoelastic glue on one surface of the layer of gypsum board, and a third layer of material selected from the group consisting of magnesium oxide-based board, gypsum board, cement-based board, metal, wood, and calcium silicate board on the second layer of fire-resistive, viscoelastic glue.

29. A laminated, sound-attenuating structure which comprises:

a layer of wood having first and second surfaces;

a first layer of fire-resistive, viscoelastic glue on one of the first and second surfaces; and a layer of calcium silicate board on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

30. The laminated, sound-attenuating structure of claim 29, further comprising a second layer of fire-resistive, viscoelastic glue on one surface of the layer calcium silicate board, and a third layer of material selected from the group consisting of gypsum board, cement-based board, metal, wood, calcium silicate board and magnesium oxide-based board on the second layer of fire-resistive, viscoelastic glue.

31. A laminated, sound-attenuating structure which comprises:

a layer of wood having first and second surfaces;

a first layer of fire-resistive, viscoelastic glue on one of the first and second surfaces; and a layer of magnesium oxide-based board on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

32. The laminated, sound-attenuating structure of claim 31, further comprising a second layer of fire-resistive, viscoelastic glue on a surface of the layer of magnesium oxide-based board, and a third layer of material selected from the group consisting of gypsum board, cement-based board, metal, wood, calcium silicate board and magnesium oxide-based board on the second layer of fire-resistive, viscoelastic glue.

33. A laminated, sound-attenuating structure comprising:

a layer of wood having first and second surfaces;

a first layer of fire-resistive, viscoelastic glue on one of the first and second surfaces; and a layer of a phosphate-based cement board on the first layer of fire-resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

34. The laminated, sound-attenuating structure of claim 33, further comprising a second layer of fire-resistive, viscoelastic glue on a surface of the layer of phosphate-based cement board, and a third layer of material selected from the group consisting of gypsum board, cement-based board, metal, wood, calcium silicate board and magnesium oxide-based board on the second layer of fire-resistive, viscoelastic glue.

35. A laminated sound-attenuating structure comprising:

a layer of fire-resistive, viscoelastic glue;

a first layer of a first selected material on one surface of the layer of fire-resistive, viscoelastic glue; and a second layer of a second selected material on another surface of the layer of fire resistive, viscoelastic glue, wherein:

said fire-resistive, viscoelastic glue contains intumescent compounds, between 30% and 70% of acrylate polymer by weight, rosin ester; and further wherein:

said fire-resistive, viscoelastic glue has a glass transition temperature below room temperature.

36. The laminated sound attenuating structure according to claim 35, wherein the first layer of the first selected material comprises a layer of gypsum board, and the second layer of a second selected material comprises a layer of material other than gypsum board.

37. The laminated structure according to claim 35, where in the first layer of the first selected material comprises a layer of cement-based board, and the second layer of a second selected material comprises a layer of material other than cement-based board.

38. The laminated structure according to claim 35, wherein the first layer of the first selected material comprises a layer of cellulose-based material.

39. The structure according to claim 35, wherein the first layer of the first selected material and the second layer of the second selected material both comprise a layer of cellulose-based material.

40. The structure according to claim 39, wherein the layer of cellulose-based material is selected from the group consisting of plywood, medium density fiber board, oriented strand board and particle board.

41. The structure according to claim 35, wherein the first layer of the first selected material is selected from the group consisting of magnesium oxide-based board, phosphate-based board and calcium silicate board.

42. The structure according to claim 35, wherein the first layer of the first selected material is comprised of a cement-based board selected from the group consisting of magnesium oxide-based board, phosphate-based board and calcium silicate board.

43. The laminated sound-attenuating structure of claim 1 wherein the first layer of fire-resistive, viscoelastic glue is applied in a pattern to some, but not all, of the interior surfaces of the first and second layers of gypsum board.

44. A laminated sound-attenuating structure comprising:

a first layer of gypsum-board having first and second surfaces;

a first layer of fire-resistive, viscoelastic glue on the first surface; and a second layer of gypsum-board on the first layer of fire-resistive, viscoelastic glue, wherein:

said fire-resistive, viscoelastic glue contains intumescent compounds, and between 30% and 70% of acrylate polymer by weight; and further wherein:

the viscoelastic glue has a glass transition temperature below room temperature.

45. The laminated sound-attenuating structure of claim 44 wherein the first layer of fire-resistive, viscoelastic glue is applied in a pattern to some, but not all, of the interior surfaces of the first and second layers of gypsum board.

46. A laminated, sound-attenuating structure comprising:

a layer of gypsum-board having first and second surfaces;

a first layer of fire-resistive, viscoelastic glue on one of the first and second surfaces; and a layer of a cement-based board on an exposed surface of the fire-resistive, viscoelastic glue, wherein:

said fire-resistive, viscoelastic glue contains intumescent compounds, between 30% and 70% of acrylate polymer by weight, a graphite intercalation compound; and further wherein:

said fire-resistive, viscoelastic glue has a glass transition temperature below room temperature.

47. A laminated, sound-attenuating structure comprising:

a layer of gypsum-board having first and second surfaces;

a first layer of fire-resistive, viscoelastic glue on one of the first and second surfaces;

a layer of calcium silicate board on the fire-resistive, viscoelastic glue, wherein:

said fire-resistive, viscoelastic glue contains intumescent compounds, between 30% and 70% of acrylate polymer by weight, a graphite intercalation compound; and further wherein:

said fire-resistive, viscoelastic glue has aglass transition temperature below room temperature.

48. A laminated, sound-attenuating structure comprising:

a layer of gypsum-board having first and second surfaces;

a first layer of fire-resistive, viscoelastic glue on one of the first and second surfaces; and a layer of a magnesium oxide-based board on the first layer of fire-resistive, viscoelastic glue, wherein:

said fire-resistive, viscoelastic glue contains intumescent compounds, between 30% and 70% of acrylate polymer by weight, and a graphite intercalation compound; and further wherein:

said fire-resistive, viscoelastic glue has a glass transition temperature below room temperature.

49. A laminated, sound-attenuating structure comprising:

a layer of gypsum-board having first and second surfaces;

a first layer of fire-resistive, viscoelastic glue on one of the first and second surfaces; and a layer of a phosphate-based cement board on the first layer of fire-resistive, viscoelastic glue, wherein:

said fire-resistive, viscoelastic glue contains intumescent compounds, between 30% and 70% of acrylate polymer by weight, a graphite intercalation compound; and further wherein:

said fire-resistive, viscoelastic glue has a glass transition temperature below room temperature.

50. A laminated, sound-attenuating structure comprising:

a first layer of a cement-based board having first and second surfaces;

a first layer of fire-resistive, viscoelastic glue on one of the first and second surfaces;

a second layer of a cement-based board on the first layer of fire-resistive, viscoelastic glue, wherein:

said fire-resistive, viscoelastic glue contains intumescent compounds, between 30% and 70% of acrylate polymer by weight, a graphite intercalation compound; and further wherein:

said fire-resistive, viscoelastic glue has a glass transition temperature below room temperature.

51. A laminated, sound-attenuating structure comprising:

a layer of cement-based board;

a first layer of fire-resistive, viscoelastic glue on a surface of the layer of cement-based board; and a layer of calcium silicate board having first and second surfaces, with the first surface on the first layer of fire-resistive, viscoelastic glue, wherein:

said fire-resistive, viscoelastic glue contains intumescent compounds, between 30% and 70% of acrylate polymer by weight, a graphite intercalation compound; and further wherein:

said fire-resistive, viscoelastic glue has a glass transition temperature below room temperature.

52. A laminated, sound-attenuating structure comprising:

a first layer of material having first and second surfaces;

a first layer of fire-resistive, viscoelastic glue on the first surface; and a second layer of material having first and second surfaces, the first surface positioned on the first layer of the fire-resistive, viscoelastic glue;

said first and second layers of material selected from the group consisting of calcium silicate and magnesium oxide, wherein:

said fire-resistive, viscoelastic glue contains intumescent compounds, between 30% and 70% of acrylate polymer by weight, a graphite intercalation compound; and further wherein:

said fire-resistive, viscoelastic glue has a glass transition temperature below room temperature.

53. A laminated, sound-attenuating structure comprising:

a first layer of phosphate-based cement board having first and second surfaces;

a first layer of fire-resistive, viscoelastic glue on the first surface; and a second layer of a phosphate-based cement board having first and second surfaces, the first surface positioned on the first layer of the fire-resistive, viscoelastic glue, wherein:

said fire-resistive, viscoelastic glue contains intumescent compounds, between 30% and 70% of acrylate polymer by weight, a graphite intercalation compound; and further wherein:

said fire-resistive, viscoelastic glue has a glass transition temperature below room temperature.

54. A laminated, sound-attenuating structure which comprises:

a layer of magnesium oxide-based cement board having first and second surfaces;

a first layer of fire-resistive, viscoelastic glue on one of the first and second surfaces; and a layer of calcium silicate board on the first layer of the fire-resistive, viscoelastic glue, wherein:

said fire-resistive, viscoelastic glue contains intumescent compounds, between 30% and 70% of acrylate polymer by weight, a graphite intercalation compound; and further wherein:

said fire-resistive, viscoelastic glue has a glass transition temperature below room temperature.

55. A laminated, sound-attenuating structure comprising:

a layer of phosphate-based cement board having first and second surfaces;

a first layer of fire-resistive, viscoelastic glue on one of the first and second surfaces; and a layer of calcium silicate board on the first layer of fire-resistive, viscoelastic glue, wherein:

said fire-resistive, viscoelastic glue contains intumescent compounds, between 30% and 70% of acrylate polymer by weight, a graphite intercalation compound; and further wherein said fire-resistive, viscoelastic glue has a glass transition temperature below room temperature.

56. A laminated, sound-attenuating structure comprising:

a layer of phosphate-based cement board having first and second surfaces;

a first layer of fire-resistive, viscoelastic glue on one of the first and second surfaces; and a layer of magnesium oxide-based board on the first layer of fire-resistive, viscoelastic glue, wherein:

said fire-resistive, viscoelastic glue contains intumescent compounds, between 30% and 70% of acrylate polymer by weight, a graphite intercalation compound; and further wherein:

said fire-resistive, viscoelastic glue has a glass transition temperature below room temperature.

57. A laminated sound-attenuating structure comprising:

a layer of fire-resistive, viscoelastic glue;

a first layer of a first selected material on one surface of the layer of fire-resistive, viscoelastic glue; and a second layer of a second selected material on another surface of the layer of fire resistive, viscoelastic glue, wherein:

said fire-resistive, viscoelastic glue contains intumescent compounds, between 30% and 70% of acrylate polymer by weight; and further wherein the viscoelastic glue has a glass transition temperature below room temperature.

* * * * *